US010881228B2

(12) United States Patent
Miller et al.

(10) Patent No.: US 10,881,228 B2
(45) Date of Patent: Jan. 5, 2021

(54) SPOUTLESS DRINKING CUP

(71) Applicant: Handi-Craft Company, St. Louis, MO (US)

(72) Inventors: Charles Miller, Barnhart, MO (US); Xiangwen Zhang, Ellisville, MO (US); Mark Reed, Columbia, IL (US); Douglas Hanneken, St. Louis, MO (US)

(73) Assignee: Handi-Craft Company, St. Louis, MO (US)

( * ) Notice: Subject to any disclaimer, the term of this patent is extended or adjusted under 35 U.S.C. 154(b) by 65 days.

(21) Appl. No.: 15/777,986

(22) PCT Filed: Nov. 23, 2016

(86) PCT No.: PCT/US2016/063454

§ 371 (c)(1),
(2) Date: May 22, 2018

(87) PCT Pub. No.: WO2017/091639

PCT Pub. Date: Jun. 1, 2017

(65) Prior Publication Data

US 2018/0344064 A1 Dec. 6, 2018

Related U.S. Application Data

(60) Provisional application No. 62/259,775, filed on Nov. 25, 2015, provisional application No. 62/328,153, filed on Apr. 27, 2016.

(51) Int. Cl.
*A47G 19/22* (2006.01)
*B65D 51/16* (2006.01)

(52) U.S. Cl.
CPC ..... *A47G 19/2272* (2013.01); *B65D 51/16* (2013.01); *B65D 51/1672* (2013.01); *B65D 51/1683* (2013.01); *B65D 51/1605* (2013.01)

(58) Field of Classification Search
CPC ..... A47G 19/2272; B65D 51/16; B65D 51/1672; B65D 51/1683
(Continued)

(56) References Cited

U.S. PATENT DOCUMENTS 2,623,368 A * 12/1952 Olsen ..... A47G 19/2272 220/711
3,727,808 A 4/1973 Fitzgerald
(Continued)

FOREIGN PATENT DOCUMENTS

CN 104323653 B 1/2016
EP 2138075 A1 12/2009
(Continued)

OTHER PUBLICATIONS

International Search Report and Written Opinion in International Application No. PCT/US2016/63454 dated Feb. 3, 2017.
(Continued)

*Primary Examiner* — Fenn C Mathew
*Assistant Examiner* — Jennifer Castriotta
(74) *Attorney, Agent, or Firm* — Armstrong Teasdale LLP

(57) ABSTRACT

A drinking cup having a receptacle with an open end and a lid assembly configured for releasable engagement with the receptacle over the open end. A lid assembly wall has an inner surface and an inner ring extending radially inward therefrom. The inner ring defines a plurality of fluid passages. A seal assembly is configured to be retained by the inner ring, with the seal assembly being resiliently deformable between a sealed configuration and an unsealed configuration. In the sealed configuration, the upper lip sealingly engages the inner surface and fluid is prevented from flowing through a lid assembly volume defined between the lid assembly and the seal assembly. In the open configuration fluid is permitted to flow from the receptacle, through
(Continued)

the plurality of fluid passages, and between a gap defined by a portion of the seal lip and a corresponding portion of the sealing surface.

14 Claims, 27 Drawing Sheets

(58) Field of Classification Search
USPC ..... 220/714, 711
See application file for complete search history.

(56) References Cited

U.S. PATENT DOCUMENTS

| | | | | |
|---|---|---|---|---|
| 3,915,331 | A | 10/1975 | Chenault | |
| 4,184,603 | A * | 1/1980 | Hamilton, Sr. | A47G 19/2272 220/254.5 |
| 4,238,045 | A | 12/1980 | D'Andri | |
| 5,890,619 | A | 4/1999 | Belanger | |
| 6,102,244 | A | 8/2000 | Kuwano et al. | |
| 6,202,877 | B1 * | 3/2001 | La Torre | A47G 19/2272 220/254.1 |
| 6,325,236 | B1 | 12/2001 | Wong | |
| 7,100,790 | B2 | 9/2006 | Dark et al. | |
| 7,549,556 | B2 * | 6/2009 | Miller | A47G 19/2272 137/853 |
| 8,025,178 | B2 | 9/2011 | Miller | |
| 8,272,525 | B1 * | 9/2012 | La Torre | A47G 19/2272 220/254.1 |
| D676,709 | S | 2/2013 | Thomas | |
| 8,418,876 | B2 | 4/2013 | Reay | |
| 8,931,654 | B2 | 1/2015 | Masurier et al. | |
| D741,658 | S | 10/2015 | Dunn et al. | |
| 9,149,138 | B2 | 10/2015 | Miller | |
| D744,281 | S | 12/2015 | Dunn et al. | |
| 9,204,746 | B2 | 12/2015 | Trudeau et al. | |
| 9,241,588 | B2 | 1/2016 | Dunn et al. | |
| 9,394,087 | B2 | 7/2016 | Phillips et al. | |
| 2005/0121405 | A1 | 6/2005 | Drajan | |
| 2006/0060149 | A1 | 3/2006 | Skowronski | |
| 2011/0062170 | A1 | 3/2011 | Kemper | |
| 2011/0084084 | A1 * | 4/2011 | Berg | A47G 19/2272 220/703 |
| 2013/0233870 | A1 * | 9/2013 | Miller | A47G 19/22 220/719 |
| 2013/0240547 | A1 | 9/2013 | Osinga et al. | |
| 2014/0305945 | A1 | 10/2014 | Chan et al. | |
| 2015/0102032 | A1 | 4/2015 | Dunn | |
| 2015/0157151 | A1 | 6/2015 | Rohrig et al. | |

FOREIGN PATENT DOCUMENTS

| | | | |
|---|---|---|---|
| GB | 2333770 | A | 8/1999 |
| WO | 2003061438 | A1 | 7/2003 |

OTHER PUBLICATIONS

EP Partial Supplementary European Search Report for related application 16869207.7 dated Aug. 6, 2019.

* cited by examiner

SPOUTLESS DRINKING CUP

BACKGROUND OF THE INVENTION

The field of the invention relates generally to drinking cups having lid assemblies through which a user can drink from the cup, and more specifically to such drinking cups in which the lid assembly does not have a spout through which the user drinks.

Drinking cups such as sport cups, travel cups and coffee mugs and children's training cups typically have a lid assembly that releasably attaches to the cup. The lid assembly may include an opening through which the user drinks from the cup, or may include a projection such as a straw or spout through which the user drinks from the cup. The opening, straw or spout in some embodiments is selectively closeable or sealable to resist leakage from the cup if the cup is dropped or tips over.

Such drinking cups, especially when used by children as a training cup, do not simulate drinking from an actual cup because the child must orient the cup in a certain manner, and can only drink from a specific location about the circumference of the lid assembly. There is a need, therefore, for a drinking cup with a spoutless lid assembly that allows the user to drink from any location about the entire circumference of the lid assembly.

SUMMARY

In one embodiment, a drinking cup generally comprises a receptacle having an open end, with the receptacle defining a liquid chamber within the receptacle. A lid assembly is configured for releasable engagement with the receptacle over the open end thereof, with the lid assembly comprising a sealing lip. A seal assembly generally comprises a sealing surface and has a plurality of fluid passages disposed transversely outward of the sealing surface. The seal assembly is configured to be retained between the receptacle and the lid assembly when the lid assembly is engaged with the receptacle. The lid assembly and the seal assembly are configured relative to each other such that the seal assembly is resiliently deformable between a sealed configuration and an unsealed configuration, wherein. In the sealed configuration, the sealing lip sealingly engages the sealing surface transversely inward of the plurality of fluid passages such that the sealing lip and the sealing surface prevent fluid from flowing from the receptacle and past the sealing lip and the sealing surface. In the open configuration, a gap is defined between at least a portion of the seal lip and a corresponding portion of the sealing surface and fluid is permitted to flow from the receptacle, through the plurality of fluid passages, and through the gap.

In another embodiment, a drinking cup generally comprises a receptacle having an open end, with the receptacle defining a liquid chamber within the receptacle. A lid assembly is configured for releasable engagement with the receptacle over the open end thereof, with the lid assembly generally comprising a lid assembly wall having an inner surface, and an inner ring extending radially inward from the lid assembly wall. The inner ring defines a plurality of fluid passages. A seal assembly is configured to be retained by the inner ring, with the seal assembly comprising an upper lip. The lid assembly and the seal assembly are configured relative to each other such that the seal assembly is resiliently deformable between a sealed configuration and an unsealed configuration. In the sealed configuration, the upper lip sealingly engages the inner surface and fluid is prevented from flowing through a lid assembly volume defined between the lid assembly and the seal assembly. In the open configuration fluid is permitted to flow from the receptacle, through the plurality of fluid passages, and between a gap defined by a portion of the seal lip and a corresponding portion of the sealing surface.

DETAILED DESCRIPTION OF THE DRAWINGS

Figure 1:
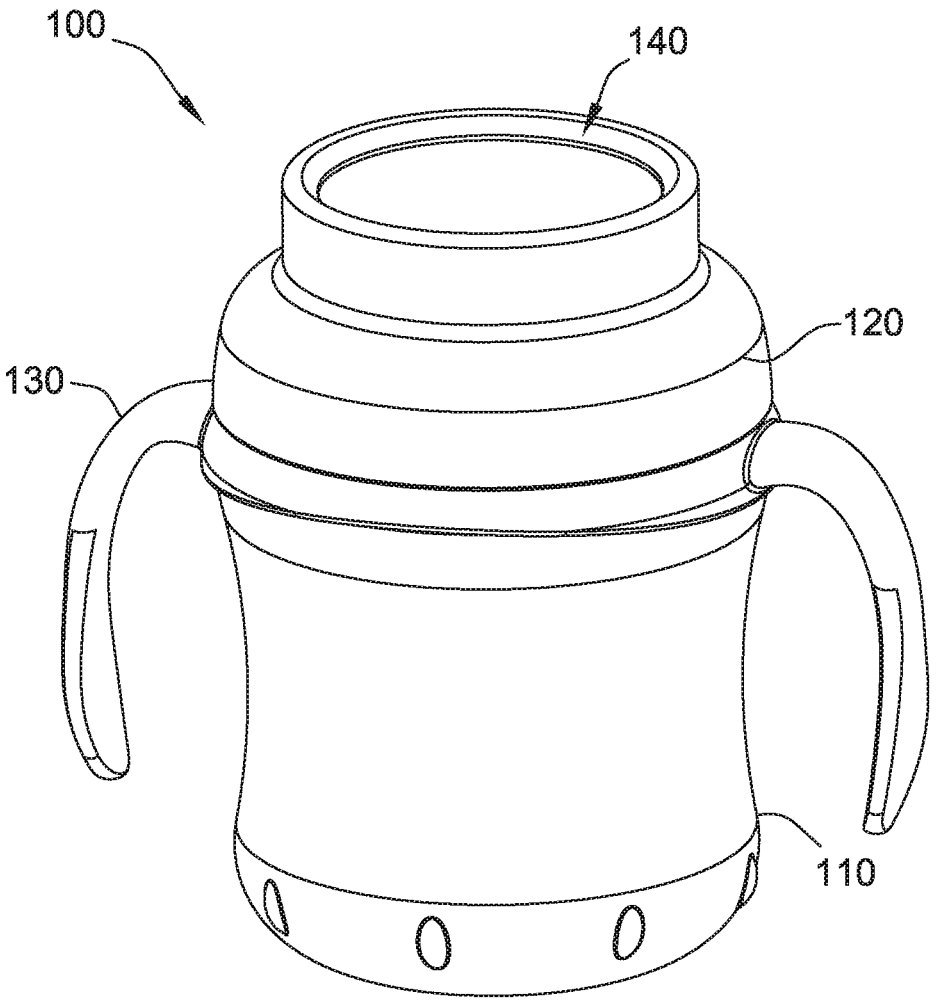
FIG. 1 is a perspective view of one embodiment of a drinking cup in the form of a children's training cup.
Figure 2:
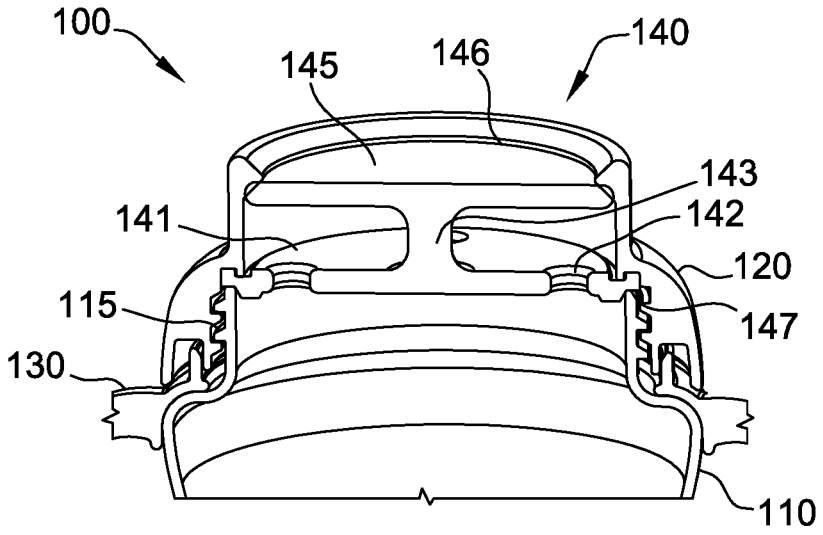
FIG. 2 is a longitudinal cross-section of a portion of the drinking cup of FIG. 1.

FIGS. 1 and 2 illustrate a drinking cup, generally indicated at 100, in the form a children's training cup used by children when transitioning between bottle feeding and drinking out of a regular cup. Training cup 100 includes a receptacle 110 for retaining liquid and a lid assembly 120 that releasably attaches—such as by threads 115 or other suitable attachment means—to the receptacle 110 to close the receptacle. Handles 130 may be provided on the training cup 100 to allow a child to grip the training cup 100 while drinking. The lid assembly includes a valve assembly, generally indicated at 140, through which the user (e.g., a child) drinks the contents of the training cup. Valve assembly 140 includes a generally disk-shaped base 141 that seats against a rim 147 of receptacle 110 upon attachment of lid assembly 120 to the receptacle 140. Base 141 includes one more orifices 142 to allow liquid to flow therethrough.

Formed integrally with base 141 is a central stem 143 extending up from the center of base 141, and a closure disk 145 at the top of the stem 143 with stem 143 also at the center of closure disk 145. Stem 143 and closure disk 145 are formed of a suitably flexible material such that closure disk 145 flexibly seals against a lip 146 at the top of lid assembly 120, lip 146 extending about the circumference of lid assembly 120. When a child wishes to drink from training cup 100, the child can press his or her mouth down against closure disk 145 to urge closure disk 145 away from lip 146 of lid assembly 120, thus allowing liquid to flow out of receptacle 110 generally in the manner of a conventional drinking cup. Accordingly, this arrangement allows the child to drink from training cup 100 at any location about the circumference of lid assembly 120. When the child is done drinking and draws his or her lip away from closure disk 145, closure disk 145 moves resiliently back into contact with lip 146 to resist leakage.

Figure 3:
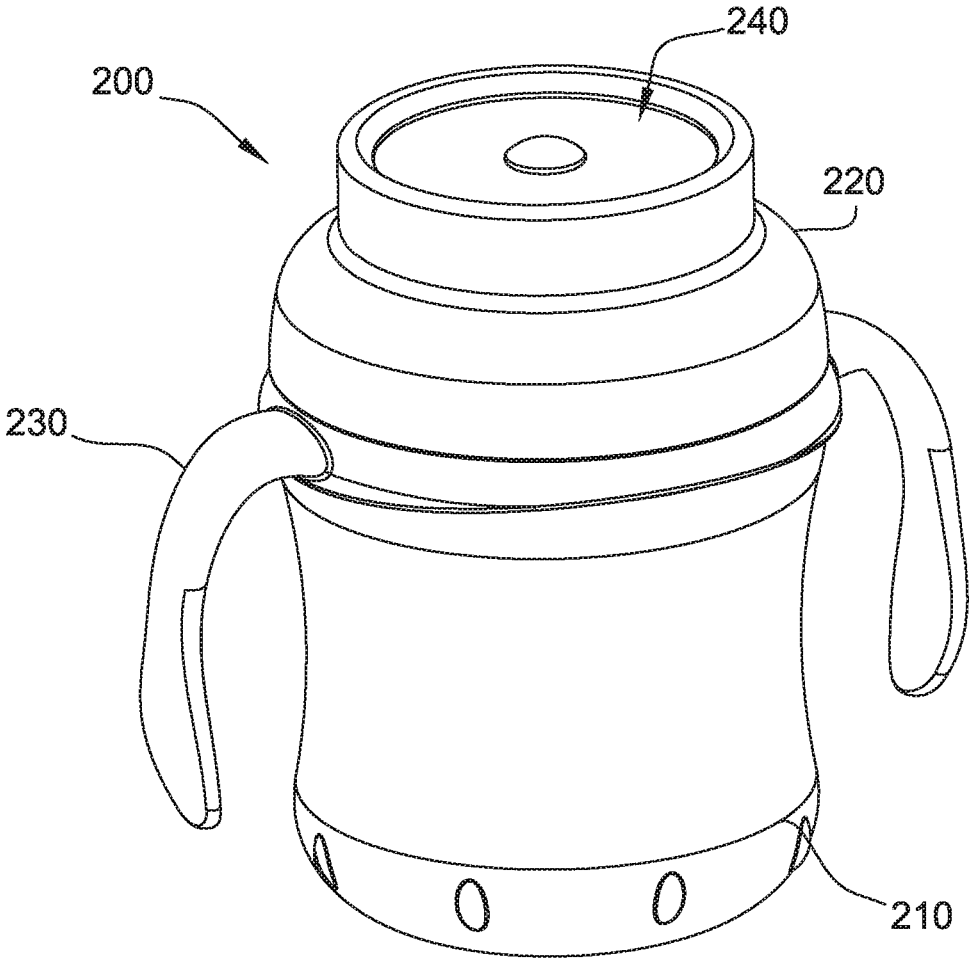
FIG. 3 is a perspective view of a second embodiment of a drinking cup in the form of a children's training cup.
Figure 4:
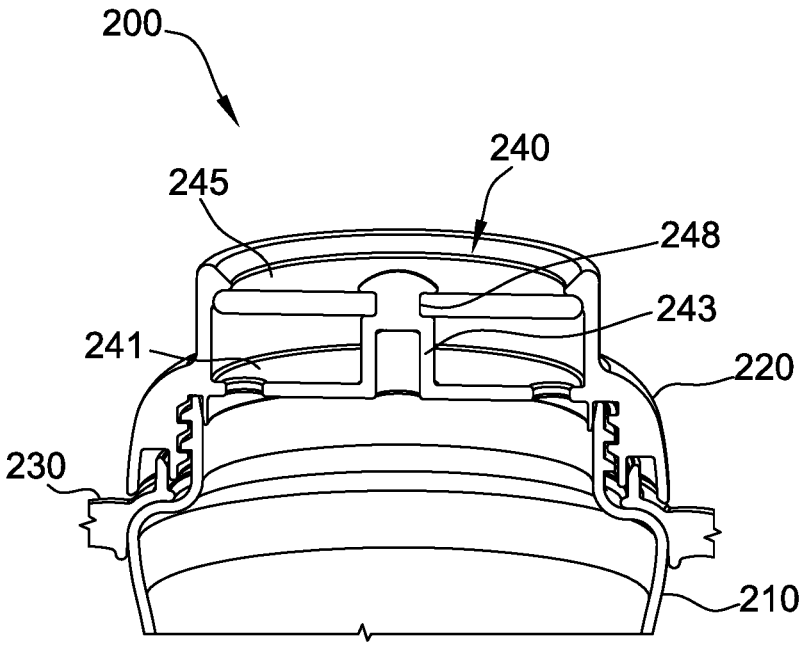
FIG. 4 is a longitudinal cross-section of a portion of the drinking cup of FIG. 3.

FIGS. 3 and 4 illustrate a second embodiment of a drinking cup 200 also in the form of a children's training cup. Training cup 200 is similar to training cup 100 of FIGS. 1 and 2 in that it includes a receptacle 210, a lid assembly 220, and optional handles 230. Valve assembly 240 includes an integrally formed base 241 and stem 243, and a separately formed closure disk 245. Stem 243 includes an annular groove 248 formed to receive closure disk 245 in a generally releasable snap fit assembly.

Figure 5:
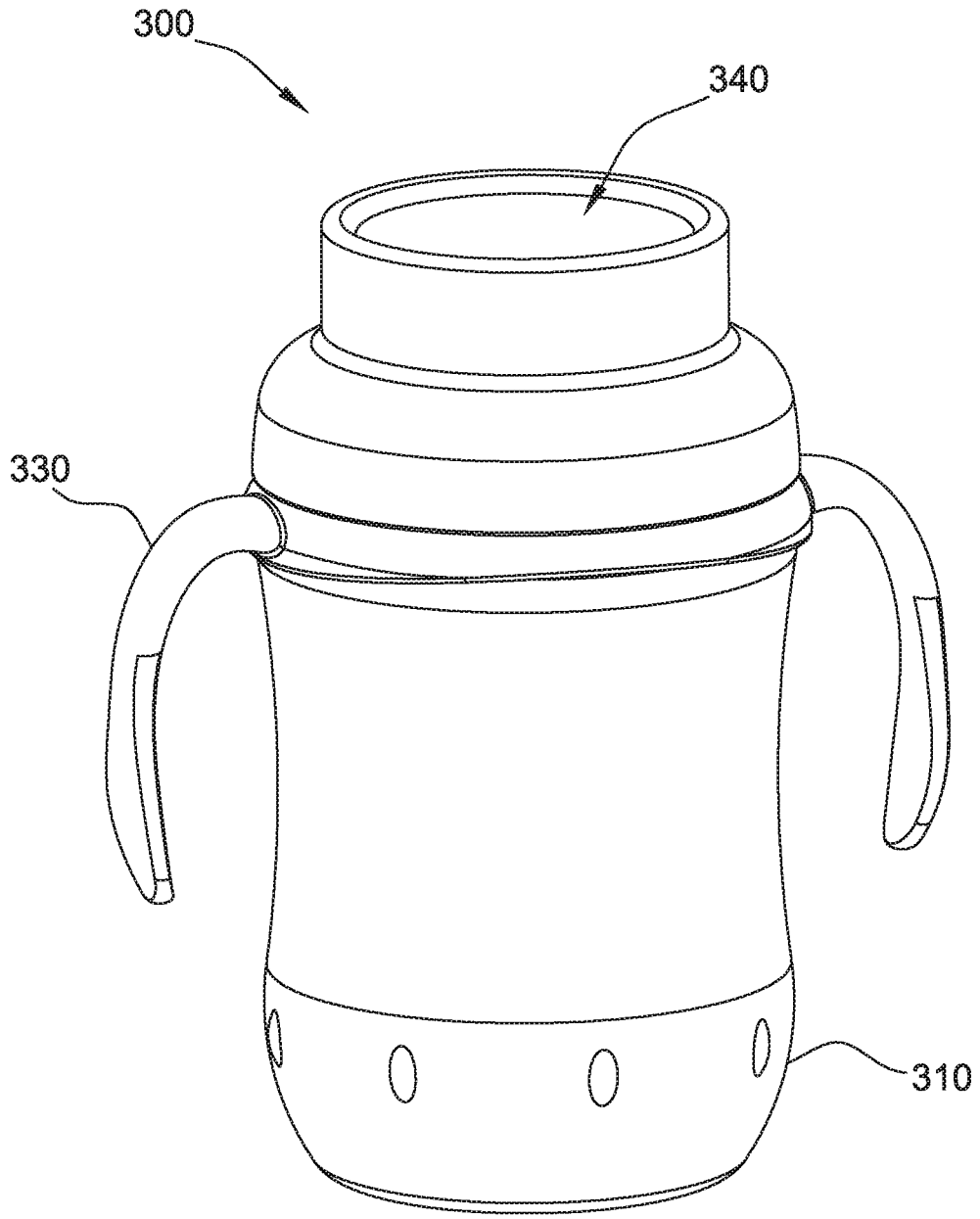
FIG. 5 is a perspective view of a third embodiment of a drinking cup in the form of a children's training cup.
Figure 6:
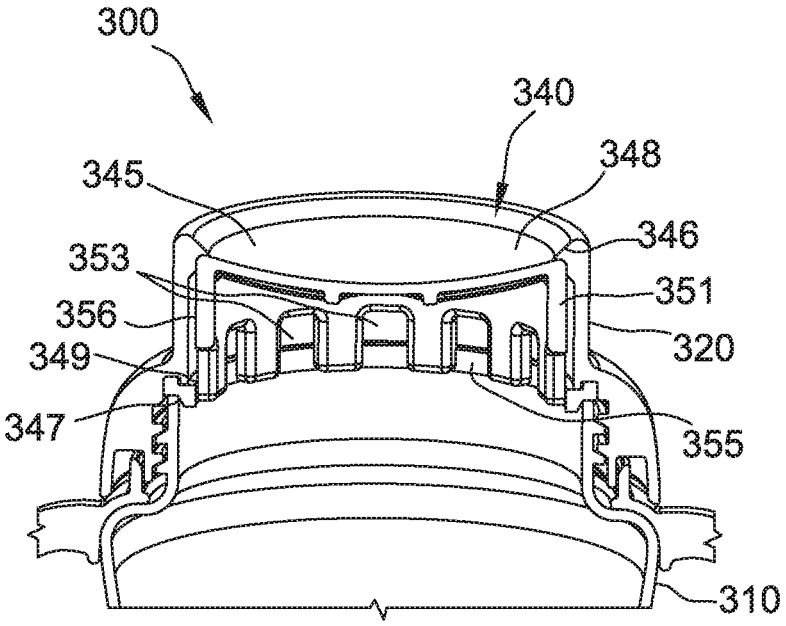
FIG. 6 is a longitudinal cross-section of a portion of the drinking cup of FIG. 5.
Figure 7:
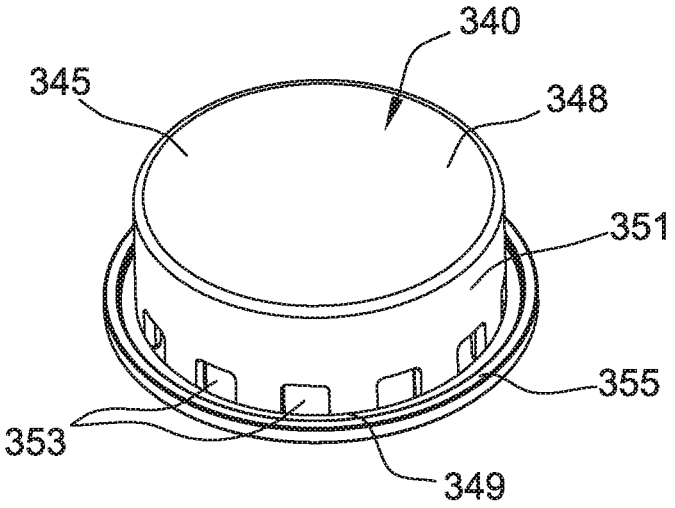
FIG. 7 is a perspective view of a valve assembly of the drinking cup of FIG. 5.

FIGS. 5-7 illustrate a third embodiment of a drinking cup 300 also in the form of a children's training cup. Training cup 300 is similar to the training cup 100 of FIGS. 1 and 2 in that it includes a receptacle 310, a lid assembly 320, and optional handles 330. Valve assembly 340 comprises a cylindrical sidewall 351 and a closure disk 345 formed integrally with sidewall 351 at an upper end 348 of sidewall 351. A flange 355 extends outward from sidewall 351 at a lower end 349 of sidewall 351 for sealing valve assembly 340 between lid assembly 320 and a rim 347 of receptacle 310. The sidewall 351 has a plurality of windows 353 formed therein generally adjacent lower end 349 and circumferentially spaced from each other about sidewall 351.

Valve assembly 340 is held in lid assembly 320 with closure disk 345 flexibly sealed against a lip 346 of lid assembly 320. When assembled, flange 355 is sealingly held between lid assembly 320 and rim 349 of receptacle 310. Sidewall 351 is otherwise transversely (e.g., radially) inward of lid assembly 320 to allow liquid to flow from receptacle 310 outward through windows 353 and into a gap 356 between sidewall 351 and lid assembly 320.

When the child (i.e., the user) wishes to drink from training cup 300, the child presses his or her mouth down against closure disk 345 to urge closure disk 345 away from lip 346, thus allowing liquid to flow out of receptacle 310 generally in the manner of a conventional drinking cup. Accordingly, this arrangement allows the child to drink from training cup 300 at any location about the circumference of lid assembly 320. When the child is done drinking and draws his or her lip away from closure disk 345, closure disk 345 moves resiliently back into contact with lip 346 of lid assembly 320 to resist leakage of liquid from training cup 300.

Figure 8:
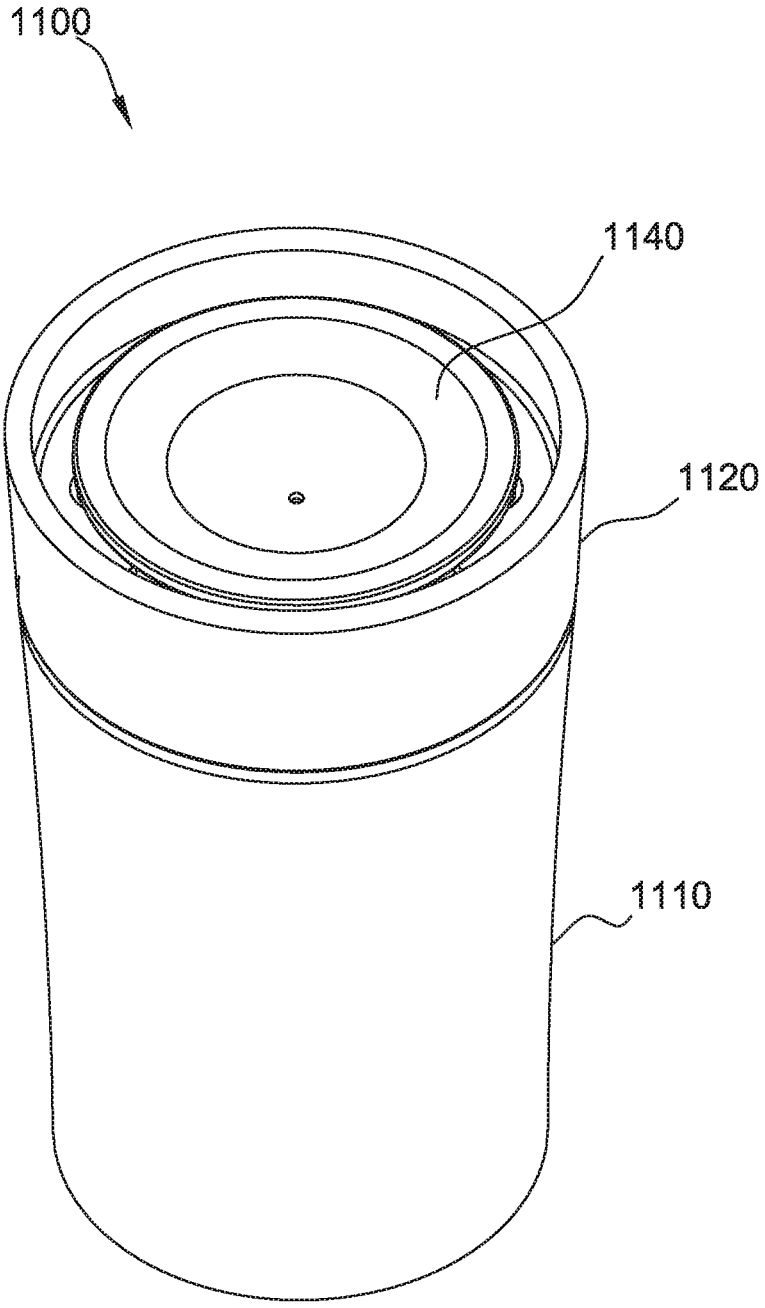
FIG. 8 is a perspective view of a fourth embodiment of a drinking cup in the form of a drinking cup.
Figure 9:
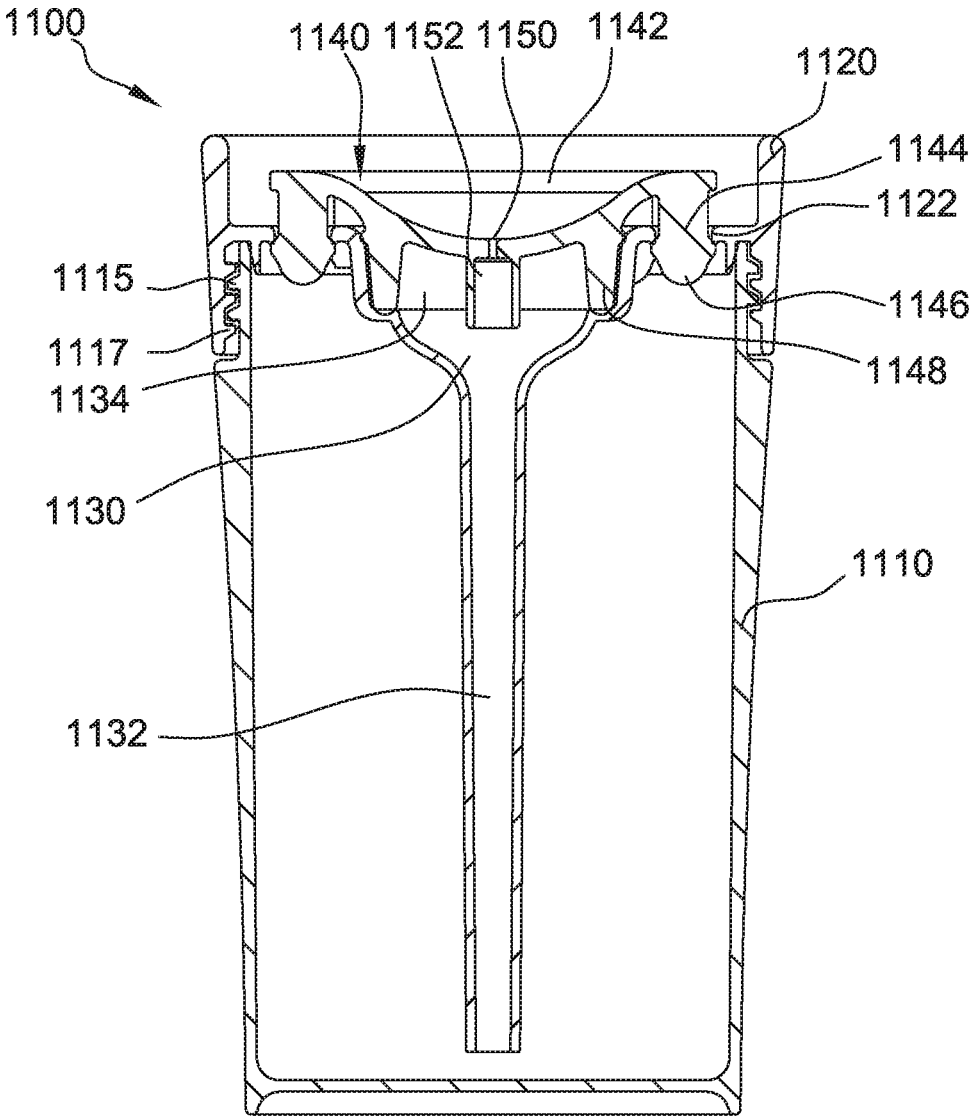
FIG. 9 is a longitudinal cross-section of the drinking cup of FIG. 8.
Figure 10:
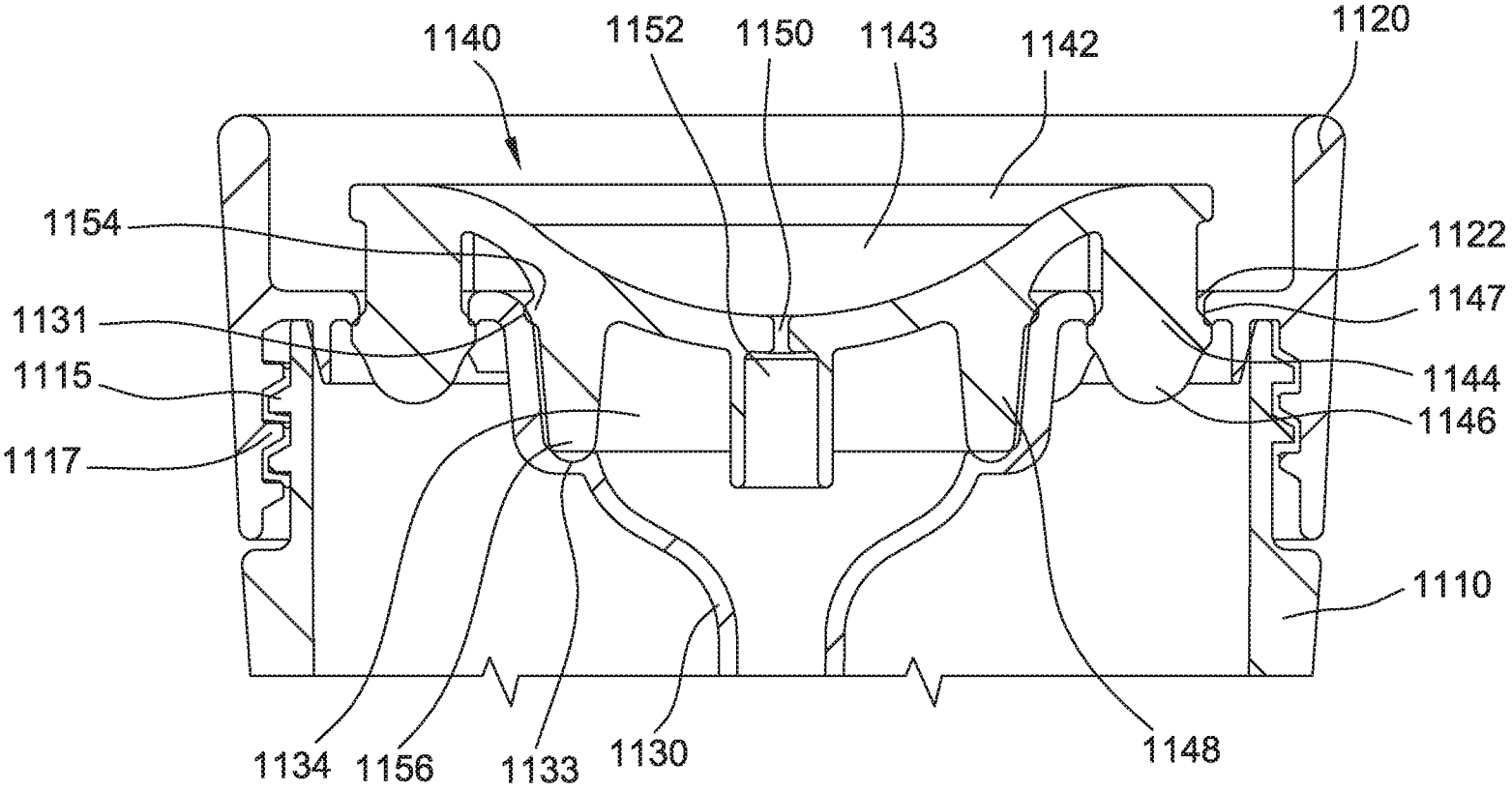
FIG. 10 is a longitudinal cross-section of a portion of the drinking cup of FIG. 8.
Figure 11:
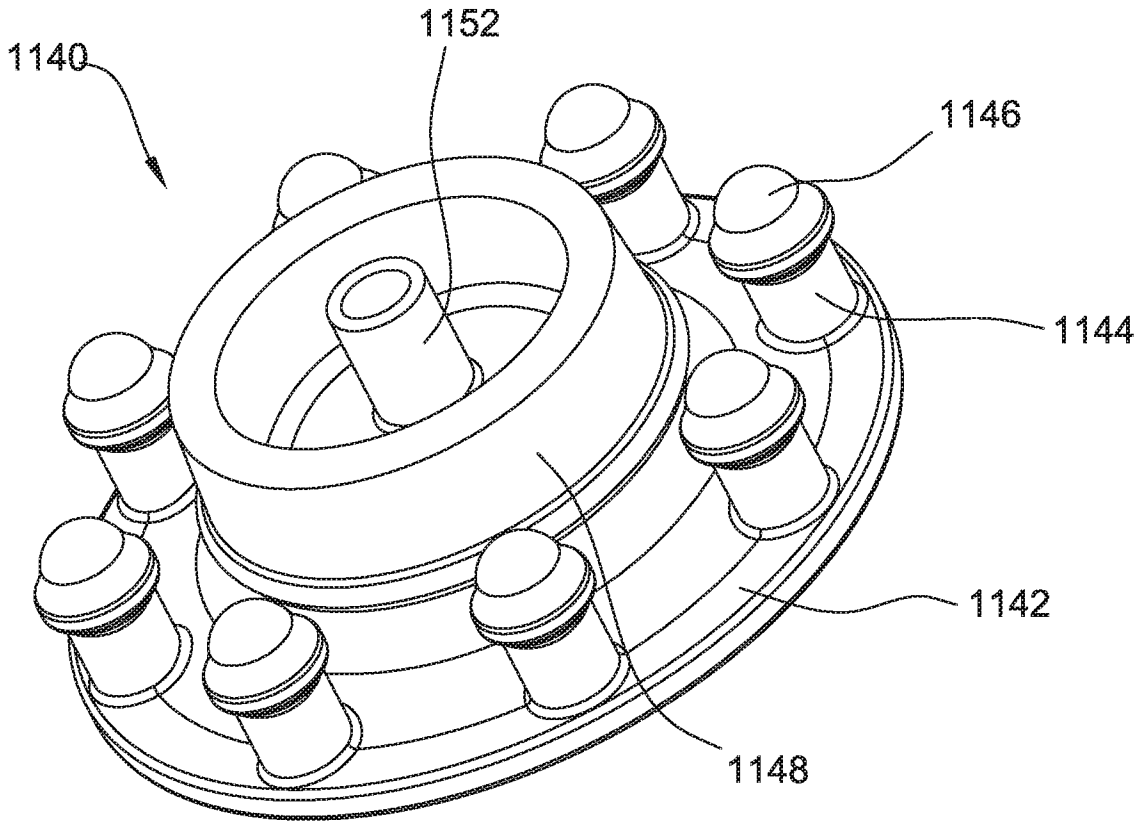
FIG. 11 is a first perspective view of an embodiment of a seal assembly for use with the drinking cup of FIG. 8.

FIGS. 8-10 illustrate a drinking cup, generally indicated at 1100. Drinking cup 1100 includes a receptacle 1110 for retaining liquid and a lid assembly 1120 that releasably attaches—such as by engaging receptacle threads 1115 with lid threads 1117 or other suitable attachment means—to receptacle 1110 to close the receptacle. Handles (not depicted) may be provided on drinking cup 1100 to allow a user (e.g., a child) to grip drinking cup 1100 while drinking.

Lid assembly 1120 defines one or more holes or fluid passages, such as hole 1122, through which liquid may flow from receptacle 1110 during use. A resilient seal assembly 1140 is coupled to lid assembly 1120 to selectively seal each of the holes defined by lid assembly 1120. Specifically, seal assembly 1140 includes a seal body 1142 having protrusions, such as protrusion 1144, which are inserted into each of the holes when seal assembly 1140 is coupled to lid assembly 1120. Each protrusion is generally composed of a resilient material and shaped to permit insertion into a corresponding hole of lid assembly 1120. For example, protrusion 1144 has a rounded and tapered tip 1146 that permits insertion into hole 1122, but generally resists removal when tip 1146 has been fully inserted through hole 1122 when protrusion 1144 is inserted into hole 1122. Protrusion 1144 may also include a tapered protrusion portion 1147 configured to abut hole 1122. Tapered protrusion portion 1147 may facilitate sealing between protrusion 1144 and hole 1122 and may also facilitate removal of seal assembly 1140 from lid assembly 1120 during disassembly of drinking cup 1100.

In FIGS. 8-10, drinking cup 1100 is depicted in a sealed configuration in which each hole of lid assembly 1120 is sealed by a corresponding protrusion of seal assembly 1140. When in the sealed configuration, fluid contained in receptacle 1110 is prevented from exiting through the holes of lid assembly 1120. When a user, such as a child, wishes to drink from drinking cup 1100, the user may cause drinking cup 1100 to enter into a second configuration in which one or more of the holes is no longer sealed by a corresponding protrusion and fluid is permitted to flow from receptacle 1110 to the user's mouth. To do so, the user may apply a force to seal body 1142 by pressing his or her mouth against a portion of seal body 1142 causing seal assembly 1140 to resiliently deform. As seal assembly 1140 deforms, one or more protrusions near the location of the applied force may move further into receptacle 1110, breaking the seal formed between the protrusions and their corresponding holes. Accordingly, as the user tips drinking cup 1100 for while maintaining the necessary force on seal body 1142 to unseat the protrusions, fluid may flow from receptacle 1110 through any of the open holes into the user's mouth. When the user is finished drinking from the cup, the user may remove his or her mouth from the drinking cup, thereby removing the force on seal body 1142. With the force removed, seal assembly 1140 returns to the sealed configuration due to its resiliency.

Seal assembly 1140 and lid assembly 1120 may include structural features that facilitate sealing while drinking cup 1100 is in the sealed configuration and to facilitate transitioning from the sealed to the open configuration. In the embodiment depicted in FIGS. 8-10, for example, seal assembly 1140 includes a convex upper portion 1143 and a cylindrical flange 1148 having a circumferential rib 1154 and a rounded flange bottom 1156. When assembled, circumferential rib 1154 abuts an upper flange shoulder 1131 of lid assembly 1120 and rounded flange bottom 1156 abuts a lowed flange shoulder 1133 of lid assembly 1120. In certain embodiments, upper and lower flange shoulders 1131 and 1133 may be formed as part of a vent assembly 1130, which is described in more detail below.

When in the sealed configuration, the shape of convex upper portion 1143 and the abutment of circumferential rib 1154 and rounded flange bottom 1156 with upper and lower flange shoulders 1131 and 1133 may serve to maintain a seal between the protrusions of seal assembly 1140 and the holes of lid assembly 1120. For example, seal assembly 1140 may be configured such that when cylindrical flange 1148 is retained by lid assembly 1120 (e.g., by upper and lower flange shoulders 1131 and 1133), inserting the protrusions of seal assembly 1140 into the holes of lid assembly 1120 requires some deformation of seal body 1142. Such deformation may induce stress in seal body 1142 along convex upper portion 1143 that, due to the resiliency of seal body 1142 and retention of cylinder flange 1148, results in an upward force (i.e., an upward pull) on the protrusions of seal assembly 1140, causing the protrusions to better seal against the holes of lid assembly 1120.

Structural elements of seal assembly 1140 and lid assembly 1120 may also interact to facilitate transition between the sealed configuration and the open configuration. For example, the contact point between circumferential rib 1154 and upper shoulder 1131 may act as a pivot point for seal assembly 1140 and seal body 1142 may act to distribute force applied to seal body 1142 across multiple protrusions. As a result, when a force is applied to seal body 1142 in the vicinity of protrusion 1144, a first set of protrusions in the vicinity of protrusion 1144 may also experience a downward force, causing them to unseat and to permit fluid to flow from receptacle 1110 to the user. At the same time, the pivot point may cause a second set of protrusions (generally opposite protrusion 1144) to be pulled upwards in response to the downward force on protrusion 1144, reinforcing the seal between the second set of protrusions and their respective holes and reducing the potential for inadvertent leakage through the second set of protrusions.

Drinking cup 1100 may be disassembled for storage, cleaning, filling, and the like, and reassembled for use. Assembly of drinking cup 1100 generally includes attaching lid assembly 1120 to receptacle 1110 and inserting seal assembly 140 into lid assembly 1120. Similarly, disassembly of drinking cup 1100 generally includes detaching lid assembly 1120 to receptacle 1110 and removing seal assembly 1140 from lid assembly 1120. During assembly or disassembly, the steps of coupling or decoupling lid assembly 1120 to receptacle 1110 and seal assembly 1140 may generally occur in any order. Moreover, certain tasks may only require partial assembly or disassembly to complete. For example, to refill drinking cup 1100, lid assembly 1120 may be removed from receptacle 1110 while still being coupled to seal assembly 1140.

In the embodiment depicted in FIGS. 8-10, lid assembly 1120 is attached to receptacle 1110 by engaging receptacle threads 1115 with lid threads 1117. Accordingly, attachment of lid assembly 1120 to receptacle 1110 generally involves twisting lid assembly 1120 in a first direction onto receptacle 1110 such that threads 1115 and 1117 engage each other. Conversely, disassembly involves twisting lid assembly 1120 in a second direction opposite the first direction to disengage threads 1115 and 1117. Receptacle threads 1115 are depicted in FIGS. 8-10 as being external to receptacle 1110 and lid threads 1117 are depicted as being internal to lid assembly 1120. In certain embodiments, however, receptacle threads 1115 may be internal threads and lid threads 1117 may be external threads. In still other embodiments, lid assembly 1120 may be attached to receptacle 1110 in other ways provided a sufficient seal is formed between lid assembly 1120 and receptacle 1110. For example, in one embodiment, lid assembly 1120 may be press fit or snapped onto receptacle 1110. A gasket or similar seal may also be disposed between lid assembly 1120 and receptacle 1110 to facilitate sealing.

To assemble seal assembly 1140 with lid assembly 1120, seal assembly 1140 is generally inserted into lid assembly 1120. Specifically, each of the protrusions of seal assembly 1140 may be aligned with corresponding holes of lid assembly 1120. Seal assembly 1140 may then be snapped into place by applying a force onto seal assembly 1140. To disassemble seal assembly 1140 and lid assembly 1120, seal assembly 1140 may be pulled away from lid assembly 1120 such that each of the protrusions of seal assembly 1140 that are engaging the holes of lid assembly 1120 pop out of their respective holes. Preferably, the force required to remove the seal assembly 1140 from the lid assembly 1120 is such that the seal assembly 1140 will not pop out of the lid assembly 1120 during use, including if the cup is dropped or inverted while full of liquid. Additionally, it is preferred that the force required to remove the seal assembly 1140 from the lid assembly 1120 be such that a small child will be unable to remove seal assembly 1140 easily from lid assembly 1120.

As shown in FIGS. 9 and 10, drinking cup 1100 may include a vent assembly 1130. Vent assembly 1130 generally permits air to flow into receptacle 110 during use, reducing or eliminating any vacuum that may be created as fluid is removed form receptacle 1110. To facilitate venting, vent assembly 1130 includes a vent tube 1132 that extends into receptacle 1110 when lid assembly 1120 engages receptacle 1110. In certain embodiments, such as the embodiment depicted in FIGS. 9 and 10, vent assembly 1130 may be integrally formed with lid assembly 1120. In other embodiments, vent assembly 1130 may be distinct from lid assembly 1120 and may be configured to sealingly engage lid assembly 1120 when drinking cup 1100 is assembled. In still other embodiments, vent assembly 1130 may be integrally formed with seal assembly 1140.

To accommodate vent assembly 1130, seal assembly 1140 may include a cylindrical flange 1148 configured to sealingly engage vent assembly 1130 when seal assembly 1140 is coupled to lid assembly 1120. Seal assembly 1140 may also define a seal vent 1150 that extends through seal body 1140 and permits air flow into vent assembly 1130 during use. To minimize leakage through seal vent 1150 during use, vent assembly 1130 and seal assembly 1140 may together define a vent reservoir 1134 and seal assembly 1140 may further include a seal vent extension 1152. Vent reservoir 1134 and seal vent extension 1152 are preferably configured such that the volume of vent reservoir 1134 adjacent to seal vent extension 1152 is greater than that of vent tube 1132.

Accordingly, if drinking cup 1100 is inverted while vent tube 1132 is full of fluid, the fluid would be retained in vent reservoir 1134 and will only enter seal vent extension 1152 minimally, if at all.

FIGS. 11-17 depict seal assembly 1140 in further detail. As previously discussed, seal assembly 1140 includes protrusions, such as protrusion 1144 extending from a seal body 1142. In embodiments in which drinking cup 1100 is vented, seal assembly 1140 may further include cylindrical flange 1148 for sealingly engaging a vent assembly, such as vent assembly 1130. Seal assembly 1140 may further include a seal vent extension 1152 corresponding to a seal vent 1150, as depicted in FIGS. 9 and 10.

Seal assembly 1140—including seal body 1142, convex upper portion 1143 and the protrusions extending from seal body 1142—are generally composed of one or more resilient materials. Embodiments of the present disclosure are not limited to any particular resilient material, however, in preferred embodiments, seal assembly 1140 is composed of one or more of silicone, latex, nitrile rubber, a thermoplastic elastomer, polyethylene, and nylon.

Figure 12:
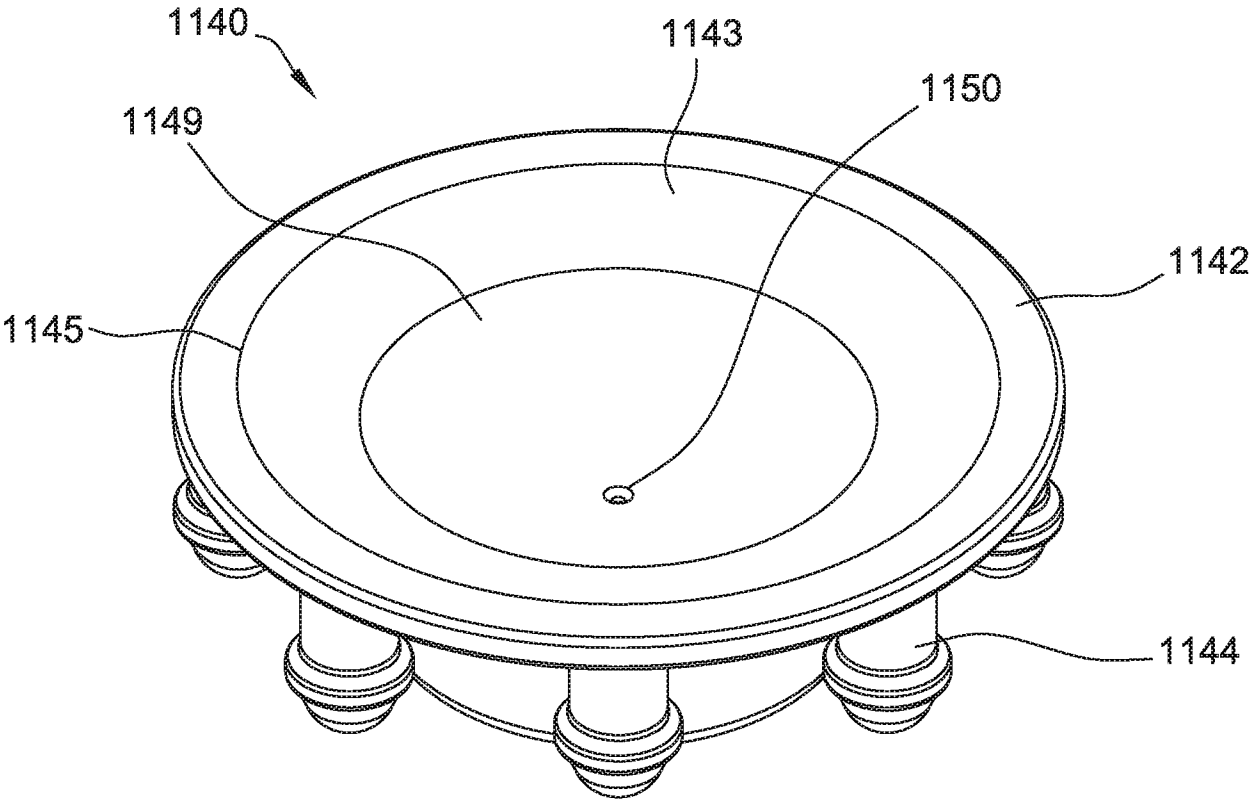
FIG. 12 is a second perspective view of the seal assembly of FIG. 11.

As shown in FIG. 12, convex upper portion 1143 as a concave indentation on the upper face of seal assembly 1140. As previously noted in the description of FIGS. 8-10, convex upper portion 1143 may be shaped to provide an upward force or bias on the protrusions of seal assembly 1140 when seal assembly is installed in lid assembly 1120, i.e., when the protrusions are inserted into the holes of lid assembly 1120. Convex upper portion 1143 provides several advantages over a seal assembly shaped like a flat plate. For example, convex upper portion 1143 reduces the overall amount of material required for seal assembly 1140, thereby reducing manufacturing costs. Convex upper portion 1143 also improves the flexibility of seal assembly 1140 as compared to a flat seal assembly design, reducing the force required to transition seal assembly 1140 from the sealed configuration to the open configuration. Finally, convex upper portion 1143 improves the ease and comfort with which a user may drink from the drinking cup. For example, convex upper portion 1143 may define a ridge or lip contour 1145 onto which a user's lips may be placed during drinking. Convex upper portion 1143 may also define a volume 1149 into which a user's nose, mouth, or other facial features may be placed during drinking, thereby avoiding the discomfort of having seal assembly 1140 pressing against the user's facial features during drinking. Volume 1149 may also permit air to flow around the user's mouth during drinking, allowing the user to breath more easily while drinking.

Figures 13, 14:
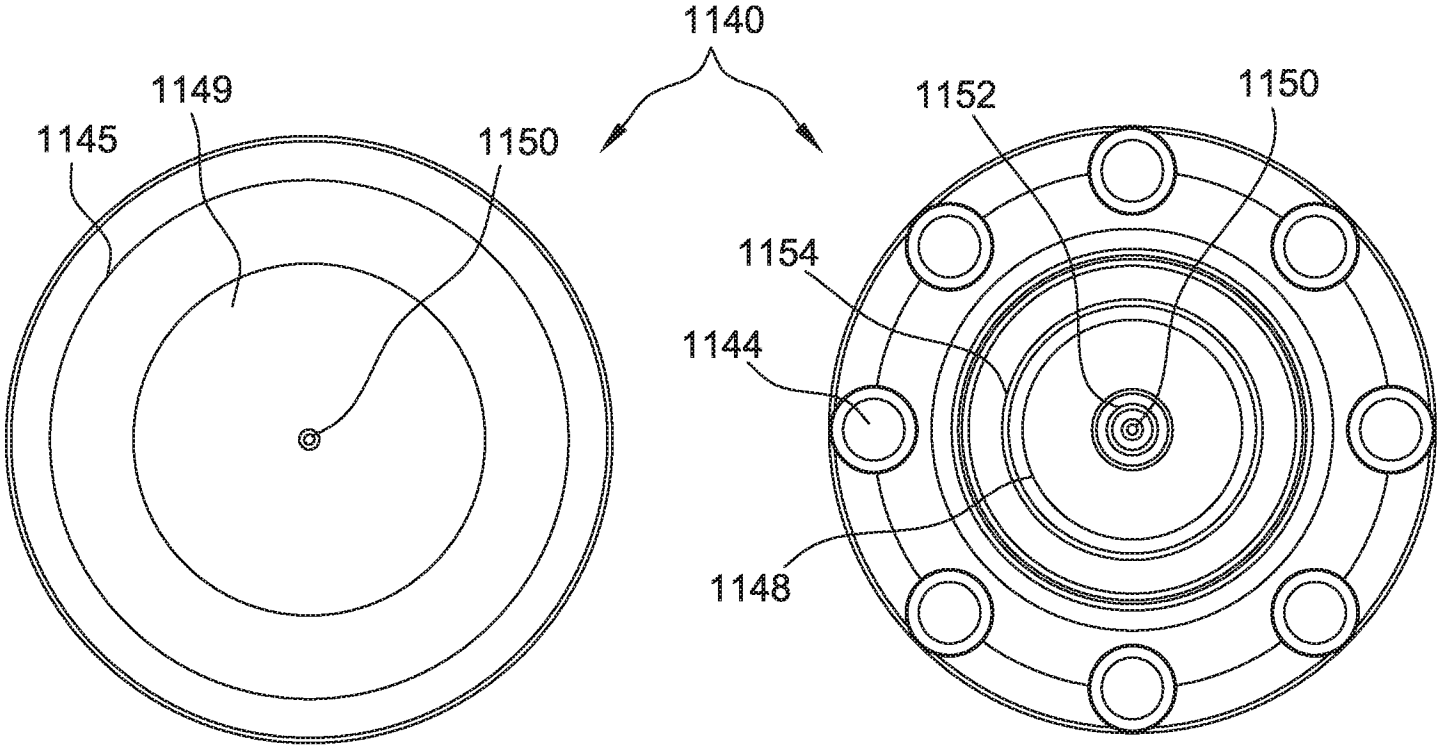
FIG. 13 is a top view of the seal assembly of FIG. 11.
FIG. 14 is a bottom view of the seal assembly of FIG. 11.

FIGS. 13 and 14 are top and bottom views of seal assembly 1140, respectively. FIG. 13 depicts an alternate view of seal body 1142 including convex upper portion 1143, lip contour 1145, and volume 1149. FIG. 14 depicts the arrangement of protrusions, such as protrusion 1144, on the bottom of seal assembly 1140. In the depicted embodiment, seal assembly 1140 includes eight protrusions uniformly distributed approximately every 45 degrees around its circumference. Other embodiments may include more or fewer protrusions and may include non-uniformly distributed protrusions. In preferred embodiments, however, the protrusions are uniformly distributed and number between four and twelve. Such preferred arrangements generally increase the likelihood that multiple protrusions will unseat from their respective holes when force is applied to seal assembly 140 during drinking, increasing the flow of fluid from the drinking cup to the user. Moreover, uniform distribution of the protrusions around seal assembly 1140 permits the drinking cup to be used from any angle with equal results.

Figure 15:
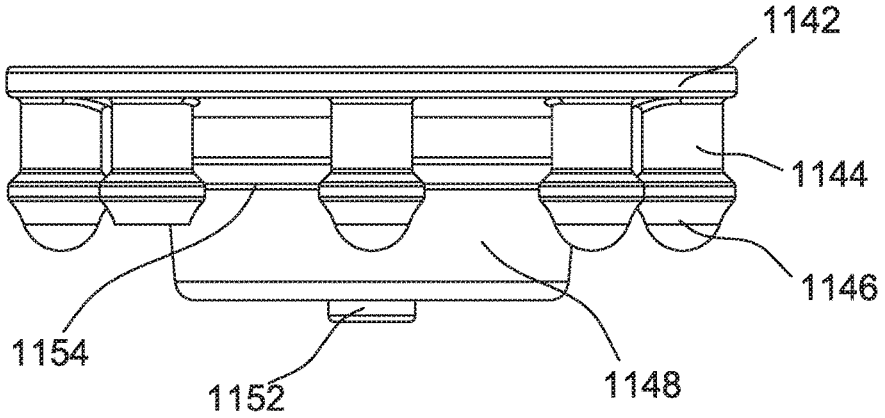
FIG. 15 is a side view of the seal assembly of FIG. 11.
Figure 16:
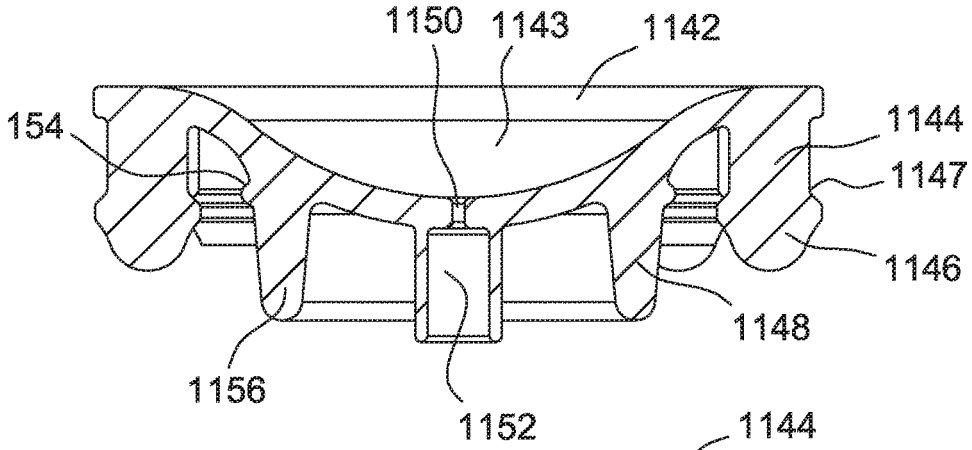
FIG. 16 is a cross-sectional view of the seal assembly of FIG. 11.

FIGS. 15 and 16 are a side view and cross-sectional side view of seal assembly 1140 providing alternate views of the features of seal assembly 1140 previously discussed in this disclosure.

Figure 17:
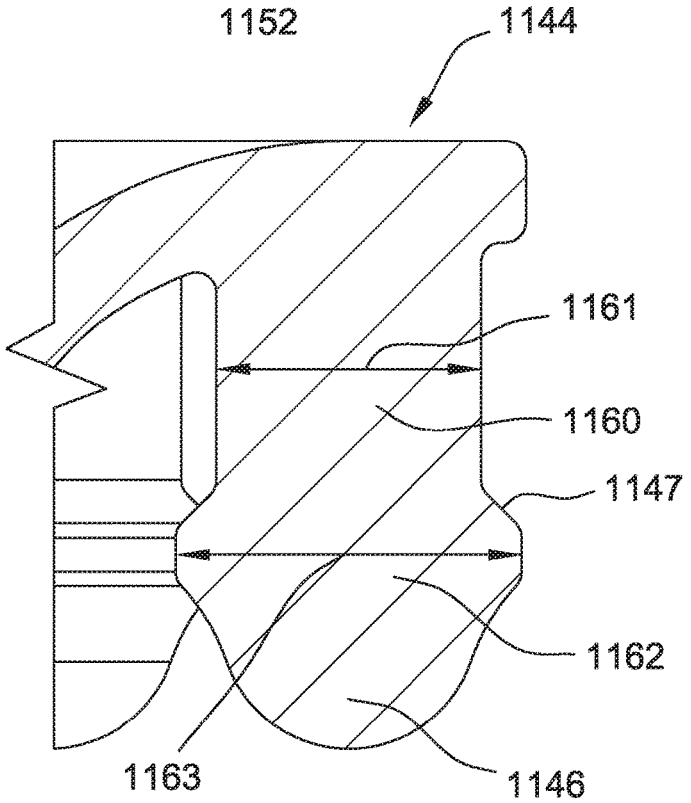
FIG. 17 is a detailed view of a protrusion of the seal assembly of FIG. 11.
Figures 19, 20:
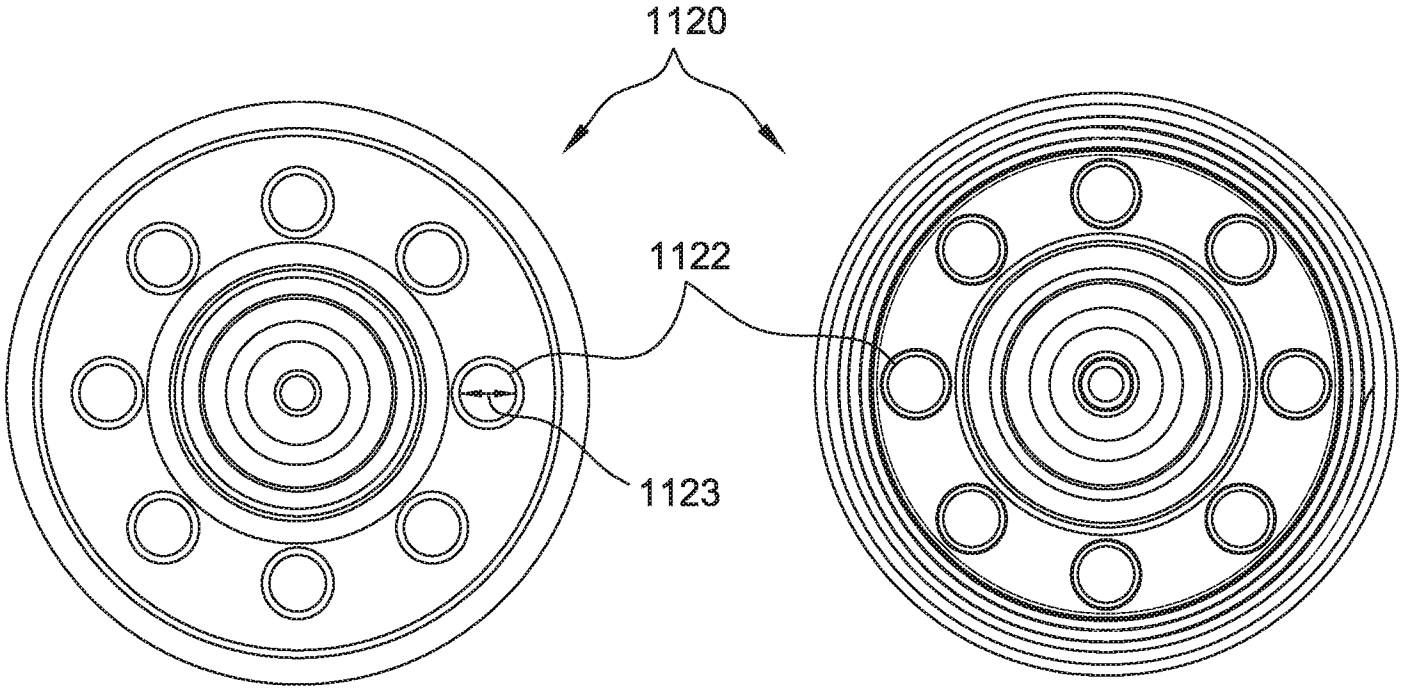
FIG. 19 is a top view of the lid assembly of FIG. 18.
FIG. 20 is a bottom view of the lid assembly of FIG. 18.

FIG. 17 is a detailed view of protrusion 1144, which is representative of each protrusion of seal assembly 1140. In the embodiment of FIG. 17, protrusion 1144 includes a rounded and tapered tip 1146 and a tapered protrusion portion 1147. Rounded and tapered tip 1146 generally facilitates assembly of drinking cup 1100 by improving the ease with which the protrusions of seal assembly 1140 may be inserted into the corresponding holes of lid assembly 1120. Tapered protrusion portion 1147 is generally shaped to seal against a side Protrusion 1144 further includes a first protrusion portion 1160 having a first protrusion diameter 1161 and a second protrusion portion 1162 having a second protrusion diameter 1163 that is wider than first protrusion diameter 1160. Seal assembly 1140 is generally configured such that when seal assembly 1140 is coupled to lid assembly 1120, first protrusion portion 1160 is maintained within a corresponding hole of lid assembly 1120, such as hole 1122 depicted in FIGS. 9 and 10. As shown in FIG. 19, hole 1122 generally has an internal diameter 1123. Preferably, first protrusion diameter 1160 is between approximately 0.08 in and approximately 0.59 in or is less than internal diameter 1123 of hole 1122 by between approximately 0.04 in and approximately 0.20 in to facilitate sealing between protrusion 1144 and hole 1122. In the embodiment depicted in FIG. 17, first protrusion diameter 1160 is approximately 0.26 in. Second protrusion diameter 1162 is greater than internal diameter 1123 of hole 1122 such that protrusion 1144 is retained within hole 1122. In preferred embodiments, second protrusion diameter 1162 is between approximately 0.16 in and approximately 0.98 in or between approximately 0.04 in and approximately 0.2 in greater than the diameter of hole 1122. Such differences between second protrusion diameter 1162 and the diameter of hole 1122 generally provide retention of seal assembly 1140 within lid assembly 1120 when assembled while permitting disassembly of seal assembly 1140 and lid assembly 1120 without requiring undue force or risking damage to either seal assembly 1140 or lid assembly 1120. In the embodiment depicted, second protrusion diameter 1162 is approximately 0.33 in.

Figure 18:
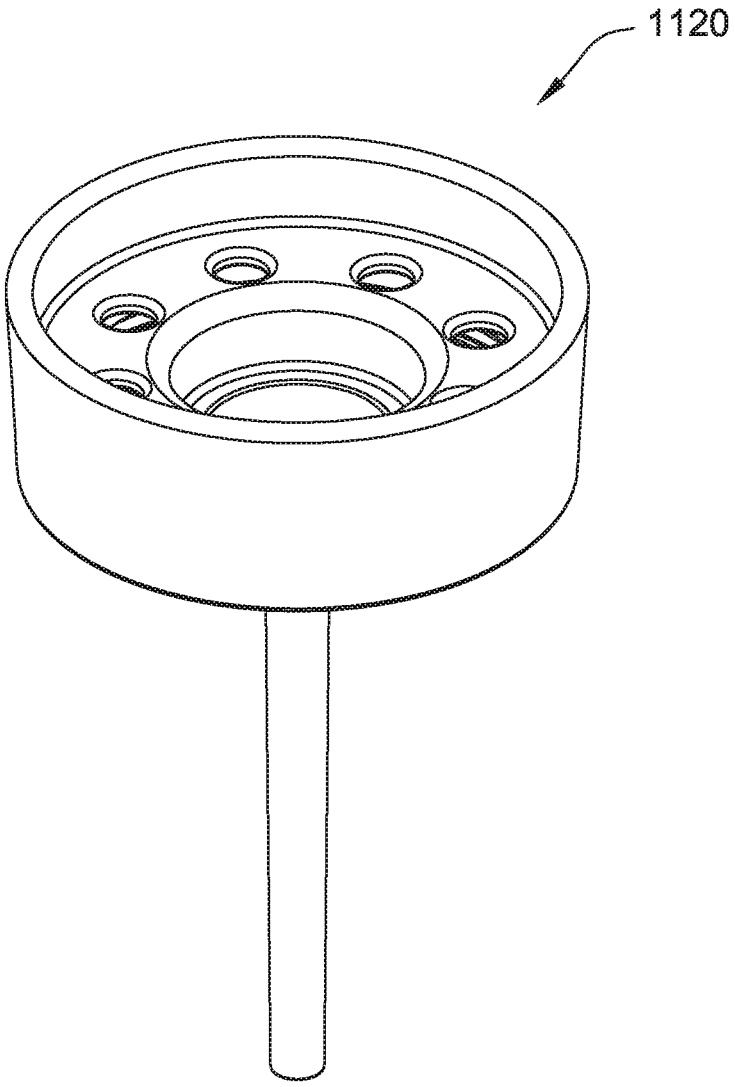
FIG. 18 is a perspective view of an embodiment of a lid assembly for use with the drinking cup of FIG. 8.

FIGS. 18-21 depict lid assembly 1120 in further detail. FIG. 18 is a perspective view of lid assembly 1120 providing an alternate view of the features of lid assembly 1120.

Figure 21:
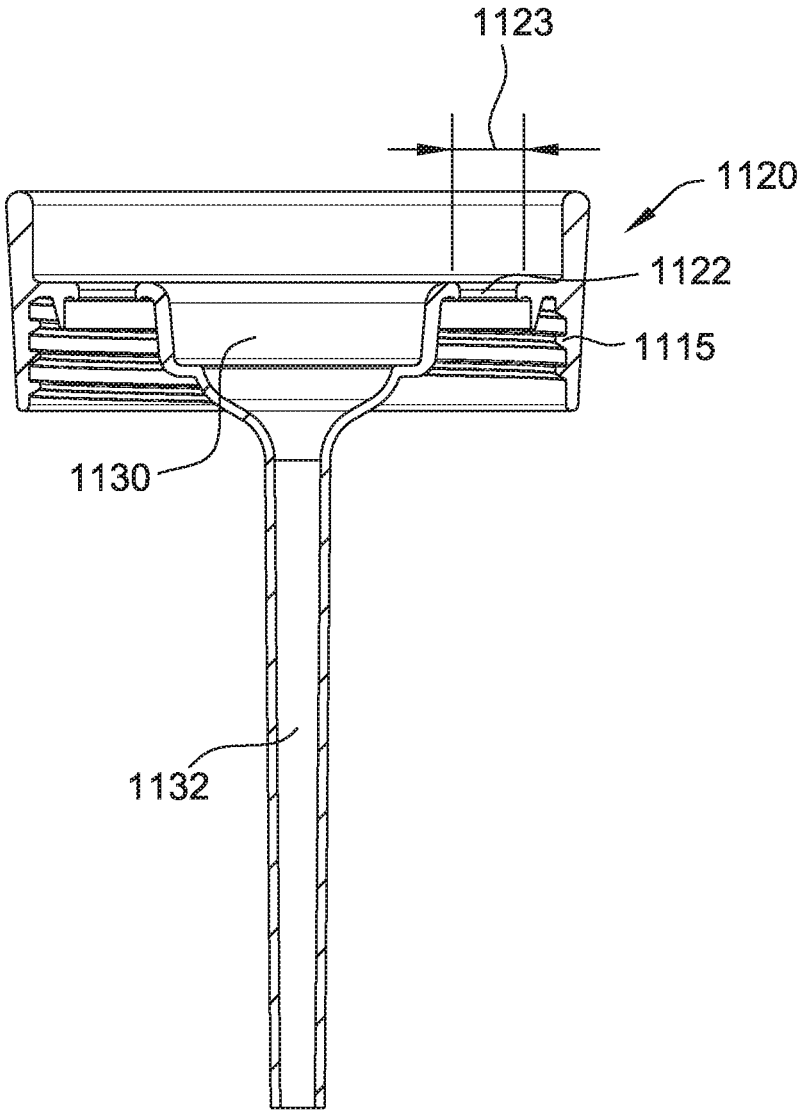
FIG. 21 is a cross-sectional view of the lid assembly of FIG. 18.

FIGS. 19 and 20 depict top and bottom views of lid assembly 1120, respectively, while FIG. 21 is a cross-sectional view of lid assembly 1120. Lid assembly 1120 includes holes, such as hole 1122, configured to receive protrusions of seal assembly 1140 when drinking cup is assembled and to permit flow of fluid from receptacle 1110 to the user. Lid assembly 1120 includes eight holes uniformly distributed about its circumference. Accordingly, adjacent holes are offset from each other by approximately 45 degrees. Other embodiments may include more or fewer holes and may include non-uniformly distributed holes. In preferred embodiments, however, lid assembly 1120 includes between four and twelve uniformly distributed holes. Such preferred arrangements generally increase the likelihood that multiple protrusions will unseat from their respective holes when force is applied to seal assembly 1140 during drinking, increasing the flow of fluid from the drinking cup to the user.

Hole 1122 is representative of each hole of lid assembly 1122. Hole 1122 preferably has an internal diameter 1123 of between approximately 0.12 in and approximately 0.79 in. Alternatively, and referring back to FIG. 17, internal diameter 1123 may be sized relative to one or both of first protrusion diameter 160 and second protrusion diameter 1162. For example, internal diameter 1123 is preferably between approximately 0.04 in and approximately 0.20 in greater than first protrusion diameter 1160 and/or between approximately 0.04 in and approximately 0.20 less than second protrusion diameter 1162. In the embodiment depicted in FIGS. 18-21, internal diameter 1123 of hole 1122 is approximately 0.30 in. The edges of hole 1122 may be beveled on one or more side to permit ease of assembly and disassembly of lid assembly 1120 and seal assembly 1140.

FIGS. 22-28 illustrate another embodiment of a drinking cup, generally indicated at 2100. Drinking cup 2100 includes a receptacle 2110 for retaining liquid and a lid assembly 2120 that releasably attaches to receptacle 2110—such as by engaging receptacle threads 2115 with lid threads 2117 or by other suitable attachment techniques—to close the receptacle. Handles (not depicted) may be provided on drinking cup 2100 to allow a user (e.g., a child) to grip drinking cup 2100 while drinking. Lid assembly 2120 includes an upper lip 2124 and a sealing lip 2126 and defines each of a retention groove 2132 and a central hole 2122. Central hole 2122 is shaped to receive a resilient seal assembly 2140. Resilient seal assembly 2140 includes an outer retention annulus 2142, a valve rim 2144, and a sealing surface 2146. Resilient seal assembly 2140 further defines a plurality of fluid passages 2148 (see, e.g., FIG. 27). When assembled, retention annulus 2142 is retained within retention groove 2132, forming a seal between lid assembly 2120 and receptacle 2110.

Figure 22:
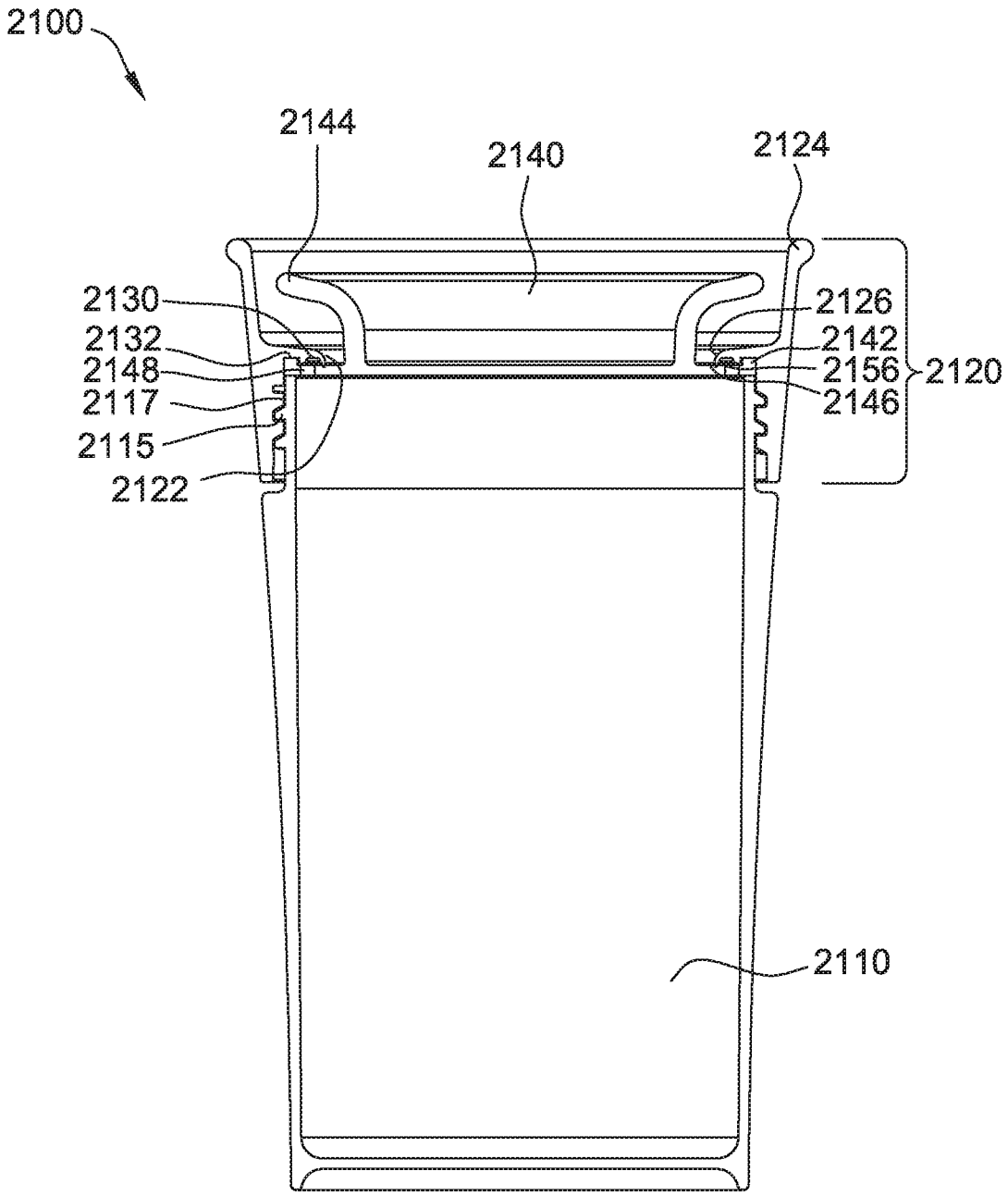
FIG. 22 is a cross-sectional view of a fifth embodiment of a drinking cup in the form of a drinking cup.
Figure 23:
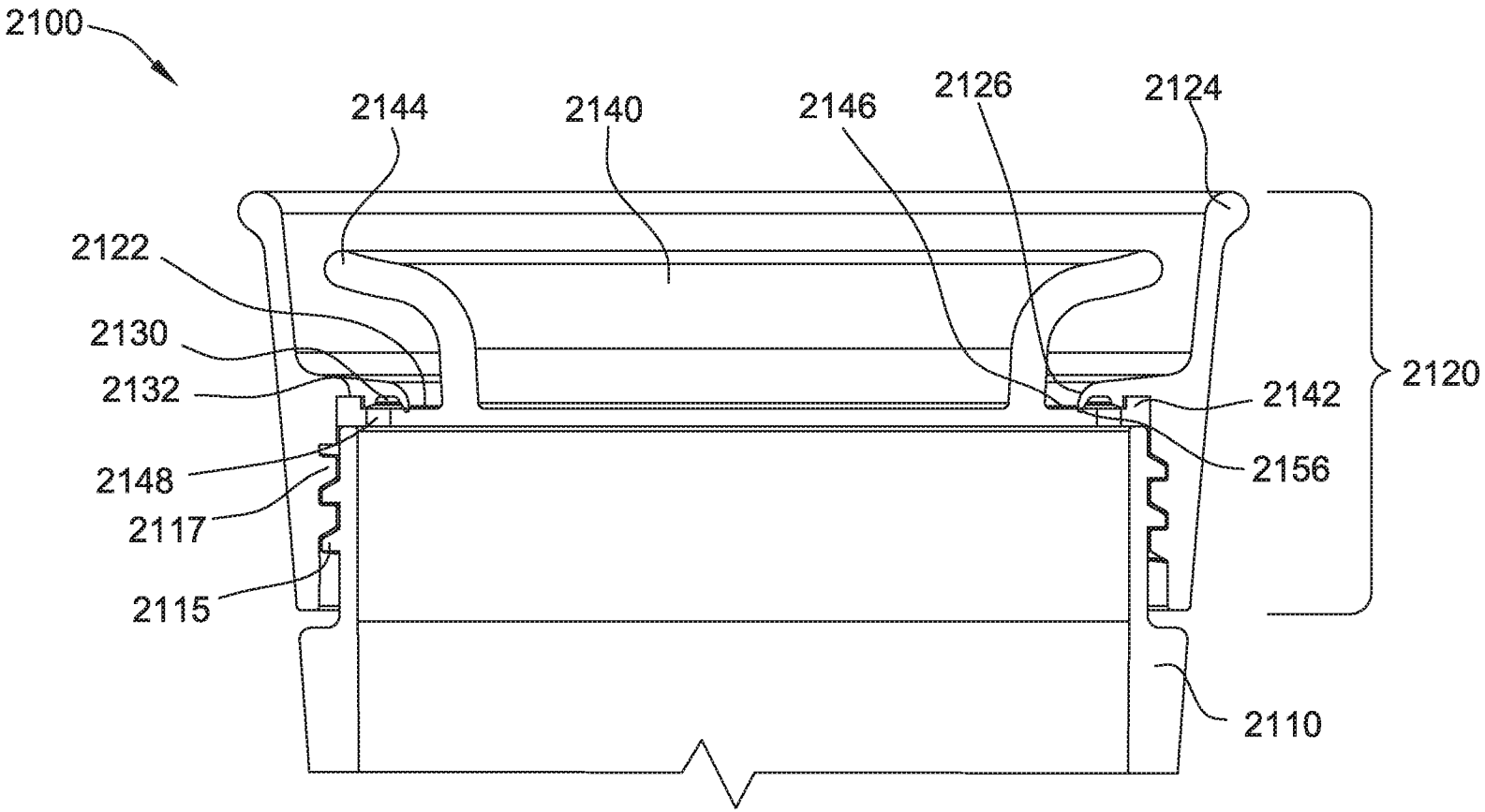
FIG. 23 is a longitudinal cross-sectional view of a portion of the drinking cup of FIG. 22 in a sealed configuration.

In FIGS. 22 and 23, drinking cup 2100 is shown in a sealed configuration in which a primary seal 2156 is formed between seal lip 2126 of lid assembly 2120 and sealing surface 2146 of resilient seal assembly 2140. When in the sealed configuration, fluid contained in receptacle 2110 is prevented from exiting through fluid passages 2148.

When a user, such as a child, wishes to drink from drinking cup 2100, the user may cause drinking cup 2100 to enter into a second, unsealed configuration in which primary seal 2156 is at least partially broken and fluid is permitted to exit receptacle 2110 from at least a portion of fluid passages 2148 to the user's mouth. To facilitate changing from the sealed configuration to the unsealed configuration, the user brings upper lip 2124 to their mouth and applies a force to valve rim 2144 by pressing his or her mouth against a portion of valve rim 2144. In response, seal assembly 2140 resiliently deforms in the vicinity of the applied force. As seal assembly 2140 deforms, at least a portion of sealing surface 2146 is displaced from seal lip 2126, breaking primary seal 2156. Accordingly, as the user tips drinking cup 2100 while maintaining the force on valve rim 2144, fluid flows from receptacle 2110, through fluid passages 2148, and into the user's mouth. When the user is finished drinking from drinking cup 2100, the user removes his or her mouth from drinking cup 2100, thereby removing the force from valve rim 2144. With the force removed, seal assembly 2140 returns to the sealed configuration due to its resiliency. In certain embodiments, sealing lip 2126 further defines a fluid groove 2130. Fluid groove 2130 is configured to facilitate fluid flow from receptacle 2110 by reducing the width of primary seal 2156.

In the exemplary embodiment, applying the force to valve rim 2144 required to break a first portion of primary seal 2156 in the vicinity of the applied force facilitates buckling of seal assembly 2144 such that a second portion of primary seal 2156, substantially opposite the first portion, also breaks. As a result, additional fluid passages 2148 opposite those from which the user is drinking are exposed, facilitating venting of receptacle 2110 during drinking. More specifically, the additional fluid passages 2148 permit air to enter receptacle 2110 during drinking, thereby reducing the likelihood of a vacuum forming within receptacle 2110.

Figure 25:
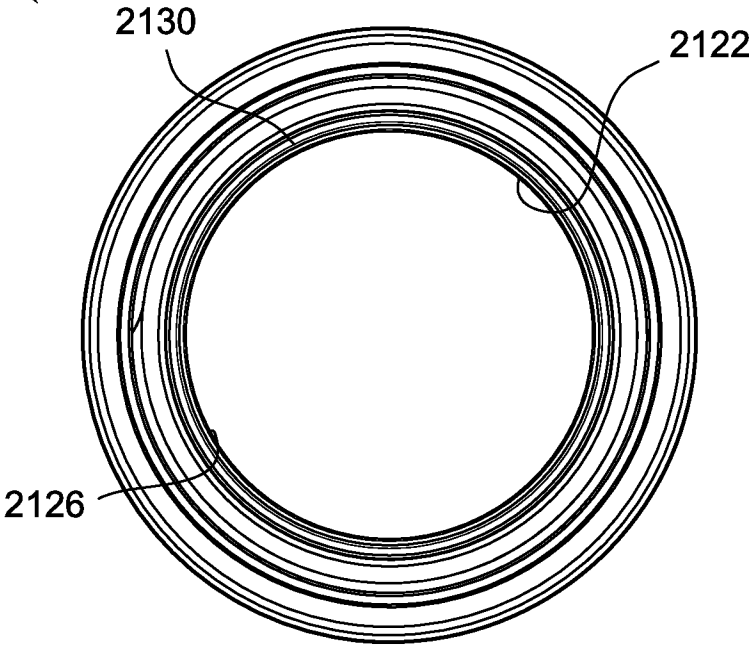
FIG. 25 is a bottom view of the lid assembly of FIG. 24.
Figure 24:
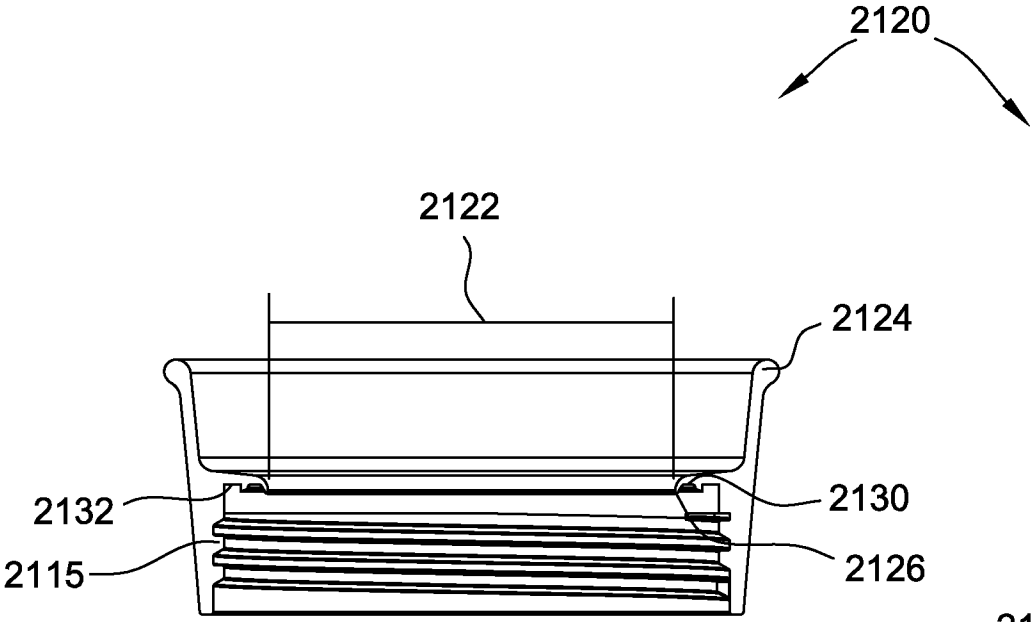
FIG. 24 is a cross-sectional view of a lid assembly for use with the drinking cup of FIG. 22.

FIGS. 24 and 25 are a cross-sectional view and a bottom view, respectively, of the lid assembly 2120. As previously discussed, lid assembly 2120 includes an upper lip 2124 and a sealing lip 2126 and defines each of a retention groove 2132, a central hole 2122, and a fluid groove 2130. In the exemplary embodiment, each of retention groove 2132 and fluid groove 2130 are continuous annular grooves that extend around the full circumference of lid assembly 2120. In alternative embodiments, either of retention groove 2132 and fluid groove 2130 may comprise a plurality of channels and/or may only extend about a portion of the circumference of lid assembly 2120. In such embodiments, seal assembly 2140 (shown in FIGS. 22 and 23) may be shaped accordingly. For example, retention annulus 2142 (shown in FIGS. 22 and 23) may include discontinuities that substantially match those of retention groove 2132 to facilitate relative alignment of lid assembly 2120 and seal assembly 2140.

Figure 27:
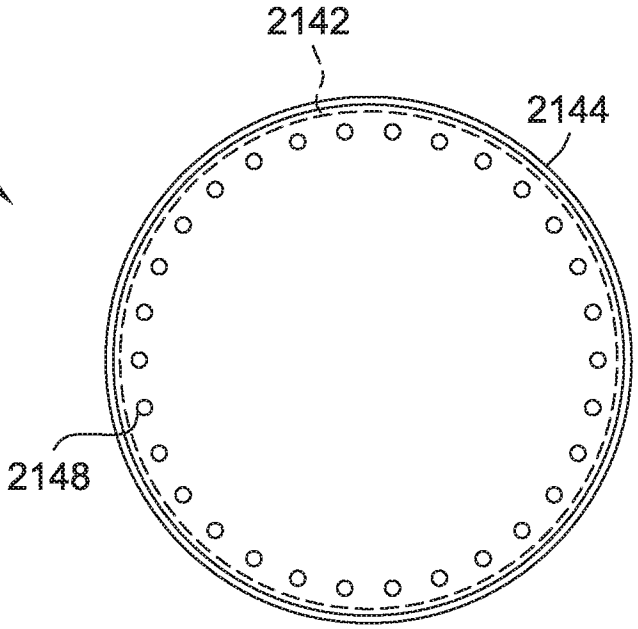
FIG. 27 is a bottom view of the seal assembly of FIG. 26.
Figure 26:
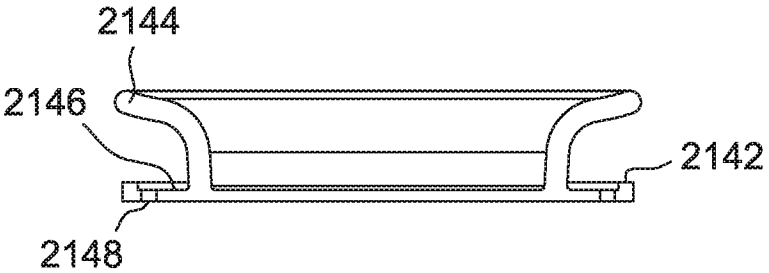
FIG. 26 is a cross-sectional view of a seal assembly for use with the drinking cup of FIG. 22.

FIGS. 26 and 27 are a cross-sectional view and a bottom view, respectively, of the seal assembly 2140. As previously discussed, seal assembly 2140 includes an outer retention annulus 2142, a valve rim 2144, and a sealing surface 2146 and defines a plurality of fluid passages 2148. In the exemplary embodiment, fluid passages 2148 are a plurality of circular passages distributed about the circumference of seal assembly 2140. Alternative embodiments may include fluid passages having non-circular shapes. For example, in certain embodiments, fluid passages 2148 may be arcuate slots and extend along a portion of the circumference of seal assembly 2140. Alternative embodiments may also include uneven distributions of fluid passages 2148 about all or part of the circumference of seal assembly 2140. For example, in certain embodiments, fluid passages 2148 may be distributed about only a portion of the circumference of seal assembly 2140 or may be more heavily concentrated within a portion of the circumference of seal assembly 2140.

Figure 28:
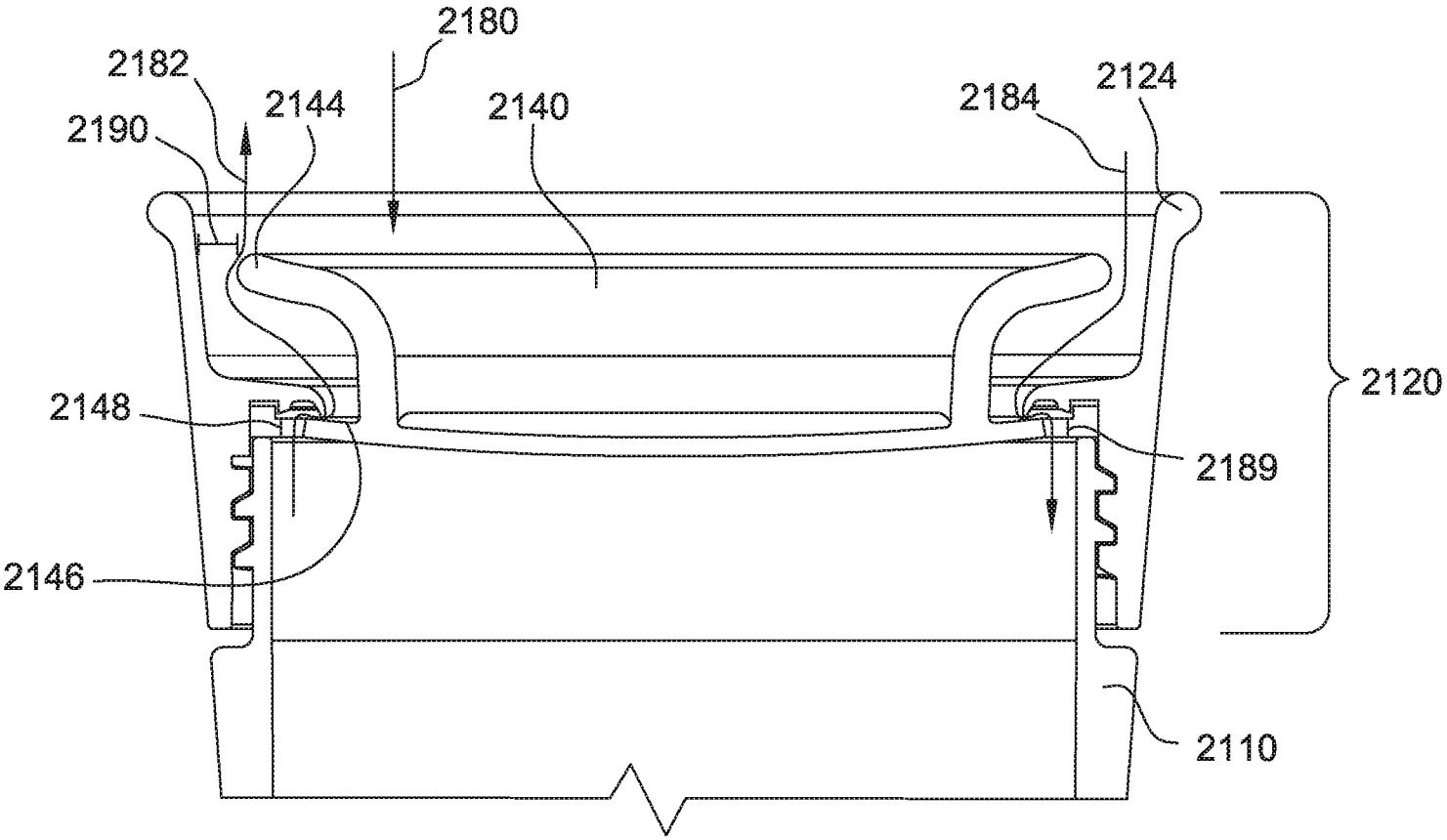
FIG. 28 is a longitudinal cross-sectional view of a portion of the drinking cup of FIG. 22 in an unsealed configuration.

FIG. 28 is a longitudinal cross-section of drinking cup 2100 in an unsealed configuration. As previously discussed, drinking cup 2100 is transitioned between a sealed and unsealed configuration by a user, such as a child, applying a force 2180 to seal assembly 2140. More specifically, the user applies force 2180 a valve rim 2144 of seal assembly 2140, which facilitates deformation of seal assembly 2140. When sufficiently deformed, sealing surface 2146 of seal assembly 2140 is displaced from sealing lip 2126 of lid assembly 2120, breaking primary seal 2156 (shown in FIGS. 22 and 23).

When primary seal 2156 is broken, a fluid flow path 2182 is provided between receptacle 2110 and the user's mouth, which is generally located adjacent to each of valve rim 2144 and an upper lip 2124 of lid assembly 2120. Fluid flow path 2182 generally extends from within receptacle 2110, through at least one first fluid passage 2148, between sealing surface 2146 and sealing lip 2126, and through an annular gap 2190 defined between valve rim 2144 of seal assembly 2140 and upper lip 2124 of lid assembly 2120.

In certain embodiments, drinking cup 2100 further facilitates venting of receptacle 2110 when drinking cup 2100 is in the unsealed configuration. When force 2180 is applied to valve rim 2144, seal assembly 2140 further deforms such that sealing surface 2146 is also displaced from sealing lip 2126 in a second portion of seal assembly 2140 adjacent at least one second fluid passage 2189. For example, in FIG. 28, second fluid passage 2189 is substantially opposite first fluid passage 2148. During use, second fluid passage 2189 permits venting to reduce the likelihood of a vacuum forming within receptacle 2110. More specifically, seal assembly 2140 is configured to deform when in the unsealed configuration such that an air flow path 2184 is defined. Air flow path 2184 generally extends through annular gap 2190, between sealing surface 2146 and sealing lip 2126, and through second fluid passage 2189 into the receptacle 2110. Accordingly, as fluid leaves receptacle 2110 along fluid flow path 2182, air may enter receptacle 2110 along air flow path 2184 to replace the fluid volume.

FIGS. 29-35 illustrate a drinking cup, generally indicated at 3100, according to yet another embodiment. Drinking cup 3100 includes a receptacle 3110 for retaining liquid and a lid assembly 3120 that releasably attaches to the receptacle 3110—such as by engaging receptacle threads 3115 with lid threads 3117 or by other suitable attachment techniques—to close the receptacle. Handles (not depicted) may be provided on drinking cup 3100 to allow a user (e.g., a child) to grip drinking cup 3100 while drinking. Lid assembly 3120 defines a central hole 3122 shaped to receive a resilient seal assembly 3140. More specifically, lid assembly 3120 includes a retention lip 3126 and seal assembly 3140 includes a retention groove 3142 configured to receive retention lip 3126 when seal assembly 3140 is inserted into central hole 3122. When assembled, retention lip 3126 and retention groove 3142 seal against each other to prevent fluid from exiting receptacle through central hole 3122. Lid assembly 3120 further includes a plurality of fluid passages 3128 disposed circumferentially about central hole 3122 to permit fluid to exit receptacle 3110 into a lid assembly volume 3155.

Figure 29:
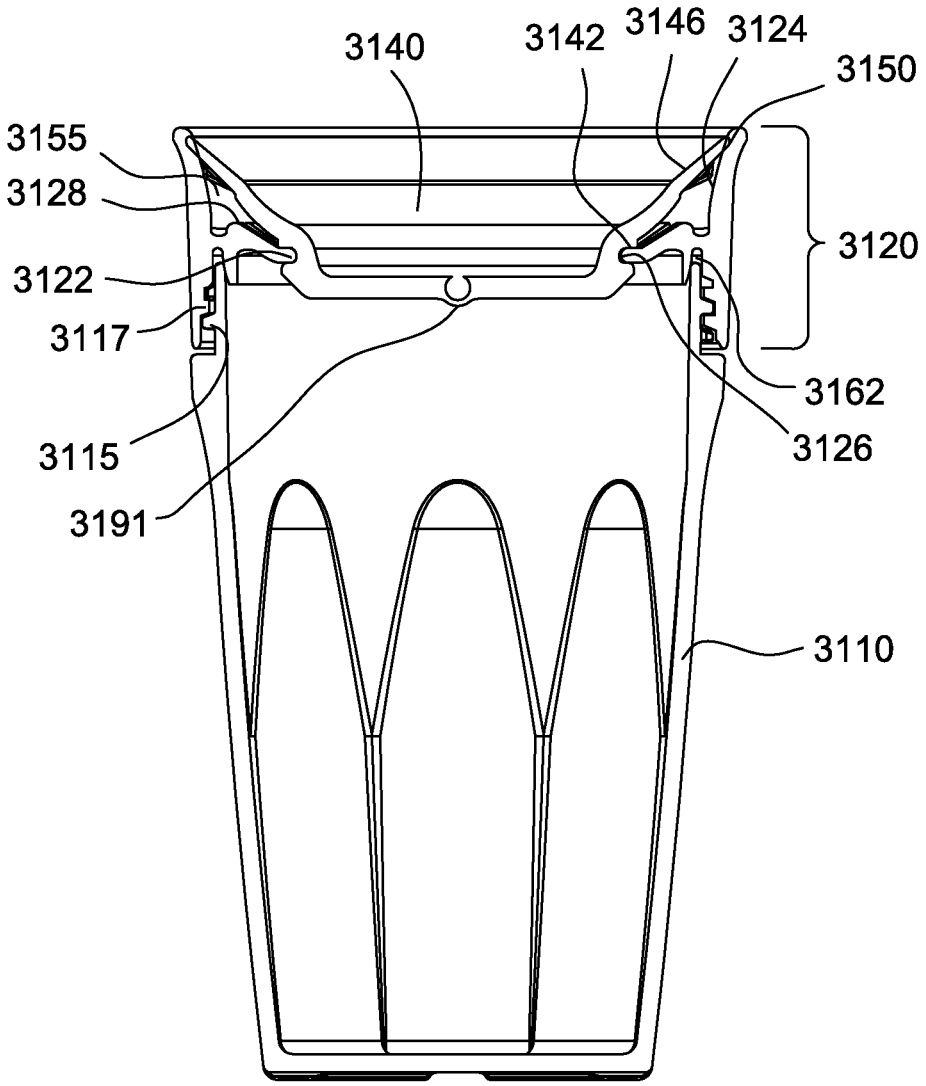
FIG. 29 is a cross-sectional view of a sixth embodiment of a drinking cup in the form of a drinking cup.
Figure 30:
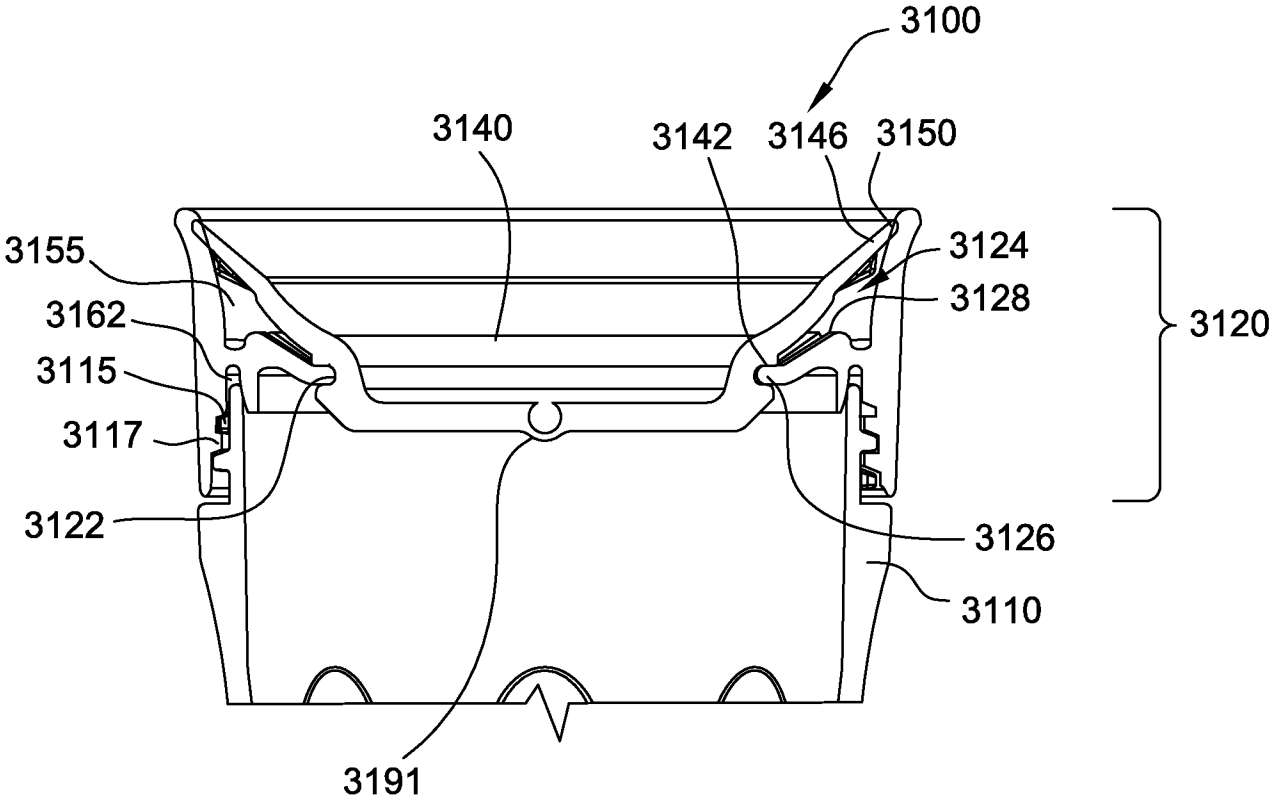
FIG. 30 is a longitudinal cross-sectional view of a portion of the drinking cup of FIG. 29 in a sealed configuration.

In FIGS. 29 and 30, drinking cup 3100 is shown in a first, sealed configuration. In the sealed configuration, an upper lip 3146 of resilient seal assembly 3140 seals against an inner surface 3124 of lid assembly 3120, forming a primary seal 3150. Primary seal 3150 generally prevents fluid from exiting drinking cup 3100. More specifically, primary seal 3150 prevents fluid from travelling beyond lid assembly volume 3155 when drinking cup 3100 is in the sealed configuration.

Figure 32:
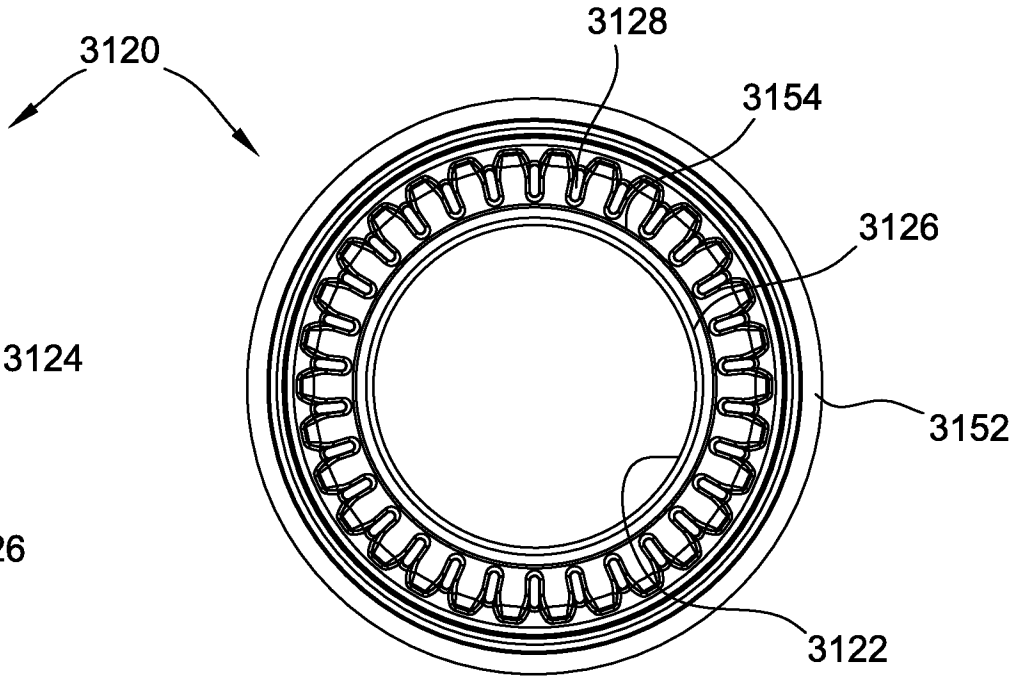
FIG. 32 is a top view of the lid assembly of FIG. 29.
Figure 31:
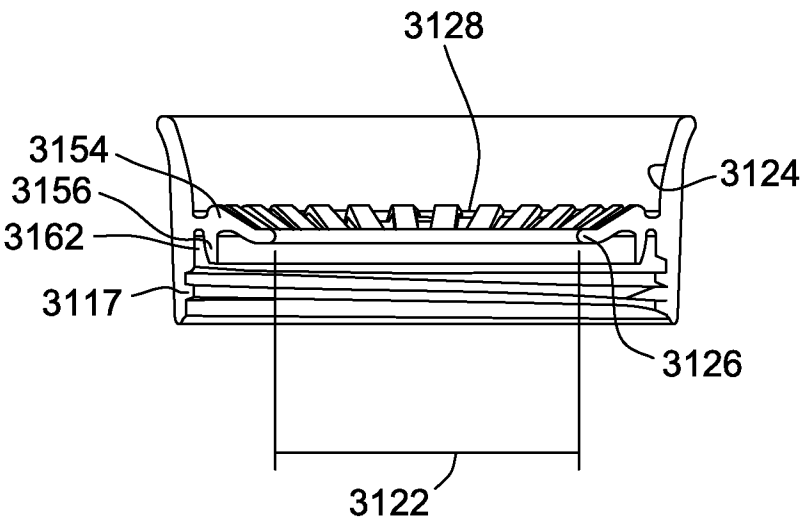
FIG. 31 is a cross-sectional view of a lid assembly for use in the drinking cup of FIG. 29.

FIGS. 31 and 32 are a cross-sectional view and top view of lid assembly 3120, respectively. As previously discussed, lid assembly 3120 defines a central hole 3122 configured to receive seal assembly 3140 (shown in FIGS. 29 and 30) and a retention lip 3126 configured to retain seal assembly 3140 within central hole 3122. Lid assembly further includes lid threads 3117 for coupling lid assembly 3120 to receptacle 3110 (shown in FIGS. 29 and 30). Lid assembly 3120 further defines a plurality of fluid passages 3128. In the exemplary embodiment, lid assembly 3120 includes a lid assembly wall 3152 and an inner ring 3154 extending inward from lid assembly wall 3152 and fluid passages 3128 are distributed about the circumference of inner ring 3154. In certain embodiments, inner ring 3154 further includes an annular projection 3156 that, together with lid assembly wall 3152, defines a receptacle gap 3162. As shown in FIGS. 29 and 30, receptacle gap 3162 is configured to receive a portion of receptacle 3110 when drinking cup 3100 is assembled. In the exemplary embodiment, receptacle 3100 seals against at least one of annular projection 3156 and lid assembly wall 3152 when drinking cup 3100 is assembled to reduce leakage from receptacle 3100.

In the exemplary embodiment, fluid passages 3128 are a plurality of slots distributed about the circumference of inner ring 3154. Alternative embodiments may include fluid passages having other shapes. For example, in certain embodiments, fluid passages 3128 may be holes through inner ring 3154. As another example, fluid passages 3128 may be arcuate channels that extend along a portion of the circumference of inner ring 3154. Alternative embodiments may also include uneven distributions of fluid passages 3128 about the circumference of inner ring 3154. For example, in certain embodiments, fluid passages 3128 may be distributed about only a portion of the circumference of inner ring 3154 or may be more heavily concentrated within a portion of the circumference of inner ring 3154.

Figure 34:
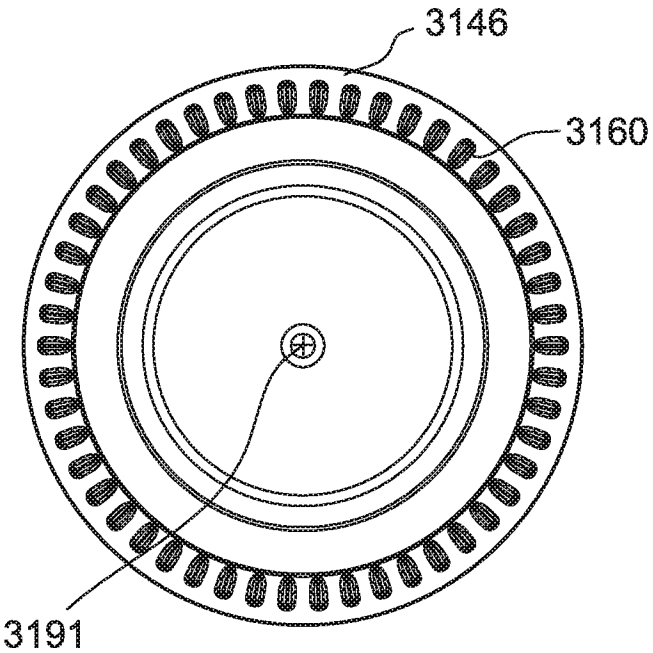
FIG. 34 is a bottom view of the seal assembly of FIG. 29.
Figure 33:
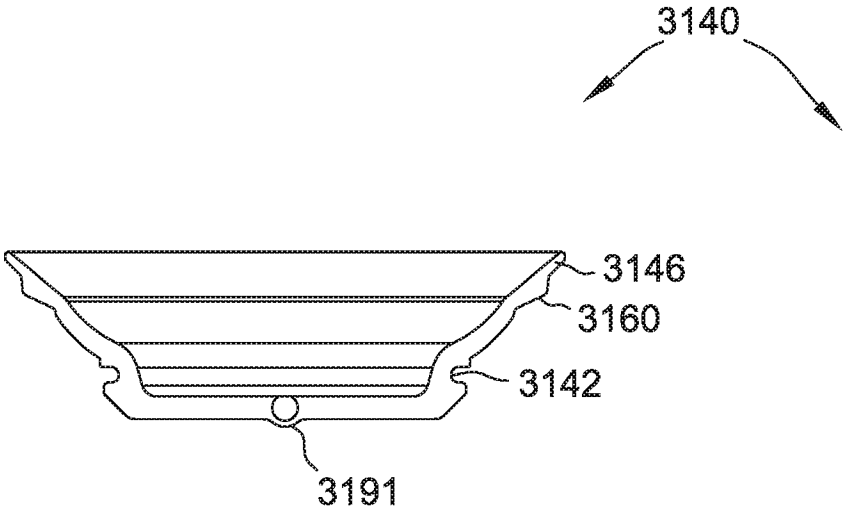
FIG. 33 is a cross-sectional view of a seal assembly for use in the drinking cup of FIG. 29.

FIGS. 33 and 34 are a cross-sectional view and a bottom view of seal assembly 3140, respectively. Seal assembly 3140 includes an upper lip 3146 and defines a retention groove 3142. When drinking cup 3100 is assembled, retention groove 3142 receives retention lip 3126 of lid assembly 3120 (as shown in FIGS. 28 and 29). Seal assembly 3140 further includes a plurality of ridges 3160. In the exemplary embodiment, ridges 3160 are distributed about the circumference of seal assembly 3140 adjacent upper lip 3146.

In certain embodiments, seal assembly 3140 includes a plurality of ridges 3160 extending adjacent upper lip 3146. These ridges 3160 generally support seal assembly 3140 within lid assembly 3120. In certain embodiments, the ridges 3160 further act as fulcrums that remain in contact with the lid assembly and facilitate controlled deformation of lid assembly 3120 about the respective fulcrum points defined by contact between the ridges and the lid assembly.

Figure 35:
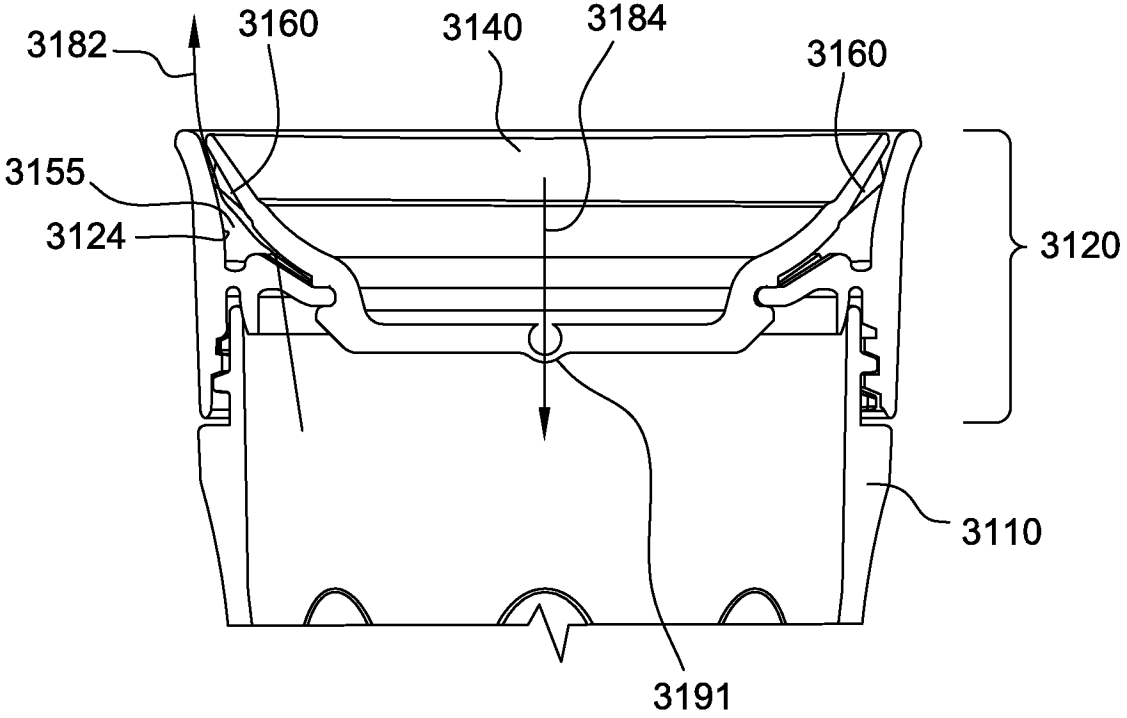
FIG. 35 is a longitudinal cross-sectional view of a portion of the drinking cup of FIG. 29 in an unsealed configuration.

When a user, such as a child, wishes to drink from drinking cup 3100, the user may cause drinking cup 3100 to enter into a second, unsealed configuration in which primary seal 3150 is at least partially broken and fluid is permitted to pass through lid assembly volume 3155 to the user's mouth. To facilitate changing from the sealed configuration to the unsealed configuration, the user places his or her lips against the seal assembly 3140 and lid assembly 3120 in a conventional manner, with the upper lip resting against the seal assembly. The user then draws fluid from the cup 3100 using a sipping or suction action that simulates a conventional drinking action such as drinking from an open cup. This sipping or suction force applied to the outer surface of the seal assembly 3120 draws the edge margin of the seal assembly 3120 away from the lid assembly 3140 to thus break the primary seal 3150 as illustrated in FIG. 35. In this manner, fluid flows from the receptacle 3110 along a first fluid passage 3182 in which fluid flows from the receptacle 3110 out through fluid passages 3128, through the lid assembly volume 3155, and into the user's mouth.

As a secondary action for breaking the seal 3150, the user may apply a force against seal assembly 3140 by pressing his or her mouth against seal assembly 3140 such that the seal assembly resiliently deforms in the vicinity of the applied force. The ridges 3160 act as fulcrums so that if the force is applied by his or her mouth radially inward of the ridges this force will cause the edge margins of the seal assembly 3140 to deform away from the lid assembly 3120 to thus break the seal 3150. The ridges 3160 also maintain an offset between seal assembly 3140 and inner surface 3124 when the drinking cup is in the unsealed configuration, facilitating passage of fluid from receptacle 3100 to the user. When the user is finished drinking from drinking cup 3100, the user removes his or her mouth from drinking cup 3100, thereby removing the suction force and/or applied force from seal assembly 3140. The seal assembly 3140 thus resiliently returns to the first, sealed configuration.

The illustrated drinking cup 3100 further includes a vent feature 3191, such as a slit valve that facilitates venting of air into the receptacle 3100 in the manner of a one-way check valve when a user is drinking from the drinking cup 3100 in the unsealed configuration. In particular, as suction is applied to allow fluid to be drawn from the drinking cup 3100, air flows in accordance with a second fluid passage 3184 into the receptacle via the vent feature 3191.

Referring back to FIGS. 1-2, a drinking cup 100 is provided. Drinking cup 100 includes a receptacle 110 having an open end and defining a liquid chamber within receptacle 110. Drinking cup 100 further includes a lid assembly 120 configured for releasable engagement with the receptacle over the open end thereof, the lid assembly including an upper lip 146. Drinking cup 100 also includes a valve assembly 140 including a base 141 disposed over the open end of receptacle 110 and defining one or more orifices 142, a closure disk 145 adjacent upper lip 146, and a central stem 143 coupling base 141 to closure disk 145. Lid assembly 120 and valve assembly 140 are configured relative to each other such that closure disk 145 is resiliently deformable between a sealed configuration in which closure disk 145 sealingly engages upper lip 146, and an open configuration in which fluid is permitted to flow from receptacle 110 and between closure disk 145 and the upper lip 146.

In an alternative embodiment of drinking cup 100, each of base 141 and central stem 143 are integrally formed with closure disk 145.

Referring to FIGS. 3 and 4, in another embodiment of a drinking cup 200, each of base 241 and central stem 243 are integrally formed with lid assembly 220. In one embodiment, the central stem defines an annular groove 248 configured to receive closure disk 245.

In an alternative embodiment of drinking cup 100, drinking cup 100 further includes at least one handle 130 coupled to at least one of lid assembly 120 and receptacle 110.

Referring to FIGS. 5-7, a drinking cup 300 is provided. Drinking cup 300 includes a receptacle 310 having an open end and defining a liquid chamber within receptacle 310. Drinking cup 300 further includes and a lid assembly 320 comprising an upper lip 346. Lid assembly 320 is configured for releasable engagement with receptacle 310 over the open end thereof. Drinking cup 300 further includes a valve assembly 340 including a cylindrical sidewall 351 defining a plurality of windows 353 through which liquid flows out of receptacle 310 and a closure disk 345 disposed at an upper end 348 of cylindrical sidewall 351 adjacent upper lip 346. Lid assembly 320 and valve assembly 340 are configured relative to each other such that closure disk 345 is resiliently deformable between a sealed position in which closure disk 345 sealingly engages upper lip 346, and an open position in which fluid is permitted to flow from receptacle 310 and between closure disk 345 and upper lip 346.

In an alternative embodiment of drinking cup 300, receptacle 310 further includes an upper rim 347 and valve assembly 340 further includes a flange 355 extending from a bottom end 349 of cylindrical sidewall 351. Flange 355 is configured to form a seal between upper rim 347 and lid assembly 320.

In another alternative embodiment of drinking cup 300, windows 353 are disposed adjacent a lower end 349 of cylindrical sidewall 351. In one such embodiment, windows 353 are circumferentially spaced from each other about lower end 349 of cylindrical sidewall 351.

Referring to FIGS. 8-21 a drinking cup 1100 is provided. Drinking cup 1100 includes a receptacle 1110 having an open end and defining a liquid chamber within receptacle 1110. Drinking cup 1100 further includes a lid assembly 1120 defining one or more fluid passages 1122. Lid assembly 1120 is configured for releasable engagement with receptacle 1110 over the open end thereof. Drinking cup 1100 further includes a seal assembly 1140 having a seal body 1142 and one or more protrusions 1144 extending from seal body 1142. Seal assembly 1140 is configured to couple with lid assembly 1120 such that when coupled, each of protrusions 1144 is inserted into a corresponding one of fluid passages 1122 of the lid assembly 1120. Lid assembly 1120 and seal assembly 1140 are configured relative to each other such that seal assembly 1140 is resiliently deformable between a sealed position in which each of protrusions 1144 sealingly engages the corresponding fluid passage 1122 into which it is inserted, and an open position in which fluid is permitted to flow out of receptacle 1110 through at least one of fluid passages 1122.

In an alternative embodiment of drinking cup 1100, seal assembly 1120 is biased into the sealed position when coupled to lid assembly 1140 and is resiliently deformable from the sealed position to the open position by applying a force to at least a portion of seal body 1142.

In another alternative embodiment of drinking cup 1100, drinking cup 1100 further includes a vent assembly 1130 positionable substantially entirely within the liquid chamber of receptacle 1110 to enable venting of drinking cup 1100 during use. In one embodiment, the vent assembly 1130 is integrally formed with lid assembly 1120. In another embodiment, seal assembly 1140 further includes a flange 1148 extending from seal body 1142 configured to sealingly engage vent assembly 1130. In such embodiments, seal assembly 1140 further defines a seal vent 1150 in communication with vent assembly 1130 such that venting of drinking cup 1100 during use occurs through seal vent 1155.

In yet another alternative embodiment of drinking cup 1100, lid assembly 1120 includes between four and twelve fluid passages 1122 and seal assembly 1140 includes an equal number of protrusions 1144 as the number of fluid passages 1122 of lid assembly 1120. In one such embodiment, lid assembly 1120 includes eight fluid passages 1122 uniformly distributed about a circumference of lid assembly 1120.

In an alternative embodiment of drinking cup 1100, seal assembly 1120 is composed of one or more of silicone, latex, nitrile rubber, a thermoplastic elastomer, polyethylene, and nylon.

In another alternative embodiment of drinking cup 1100, each of the fluid passages 1122 has a diameter of between approximately 0.12 inches and approximately 0.79 inches. In one such embodiment, each of fluid passages 1122 has a diameter of approximately 0.30 inches. In another of such embodiments, each of fluid passages 1122 has a diameter of approximately 0.30 inches and each of protrusions 1144 further includes a first protrusion portion 1160 having a first protrusion diameter 1161 of approximately 0.26 inches and a second protrusion portion 1162 having a second protrusion diameter 1163 of approximately 0.33 inches.

In yet another alternative embodiment of drinking cup 1100, each of protrusions 1144 includes a first protrusion portion 1160 having a first protrusion diameter 1161 between approximately 0.08 inches and approximately 0.59 inches and a second protrusion portion 1162 having a second protrusion diameter 1163 between approximately 0.16 inches and approximately 0.98 inches.

In an alternative embodiment of drinking cup 1100, each protrusion 1144 further comprises a rounded and tapered tip 1146.

In another alternative embodiment of drinking cup 1100, lid assembly 1120 includes one or more lid threads 1117 and receptacles 1110 includes one or more receptacle threads 1115 and lid assembly 1120 and receptacle 1110 are configured to be resealably engaged by threads 1115/1117.

When introducing elements of the present invention or the various versions, embodiment(s) or aspects thereof, the articles "a", "an", "the" and "said" are intended to mean that there are one or more of the elements. The terms "comprising", "including" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above without departing from the scope of the invention, it is intended that all matter contained in the above description and shown in the accompanying drawings shall be interpreted as illustrative and not in a limiting sense.

What is claimed is:

1. A drinking cup comprising:

a receptacle having an open end and comprising a receptacle rim at the open end, the receptacle defining a liquid chamber within the receptacle;

a lid assembly configured for releasable engagement with the receptacle over the open end thereof, the lid assembly comprising a lid assembly wall having an inner surface, and an inner ring extending radially inward from the lid assembly wall, the inner ring defining a plurality of fluid passages, the lid assembly further comprising an annular projection extending axially from the inner ring to a free end of the lid assembly, the annular projection and the inner surface of the lid assembly wall defining a receptacle gap therebetween, the lid assembly configured to receive at least a portion of the receptacle rim within the receptacle gap when the lid assembly is releasably engaged to the receptacle; and a seal assembly configured to be retained by the inner ring, the seal assembly comprising an upper lip, wherein the lid assembly and the seal assembly are configured relative to each other such that the seal assembly is resiliently deformable between a sealed configuration and an unsealed configuration, wherein:

in the sealed configuration, the upper lip sealingly engages the inner surface and fluid is prevented from flowing through a lid assembly volume defined between the lid assembly and the seal assembly, and in the unsealed configuration fluid is permitted to flow from the receptacle, through the plurality of fluid passages, and between a gap defined by a portion of the upper lip and a corresponding portion of the inner surface.

2. The drinking cup of claim 1, wherein the inner ring comprises a retention lip, the seal assembly defines a retention groove, and the seal assembly is configured to be retained by the inner ring by retaining the retention lip within the retention groove.

3. The drinking cup of claim 1, wherein the receptacle rim seals against at least one of the lid assembly wall and the annular projection when the lid assembly is releasably engaged to the receptacle.

4. The drinking cup of claim 1, wherein the fluid passages are radially extending slots distributed about the circumference of the inner ring.

5. The drinking cup of claim 1, wherein the seal assembly further comprises a plurality of ridges distributed adjacent to the upper lip such that the ridges abut the inner surface and wherein, in the unsealed configuration, the seal assembly resiliently deforms about at least a portion of the ridges.

6. The drinking cup of claim 1, wherein the seal assembly further comprises a one-way vent feature through which air flows into receptacle during drinking of fluid therefrom in the unsealed configuration.

7. The drinking cup of claim 1, wherein the seal assembly is resiliently deformable between the sealed configuration and the unsealed configuration by applying force to the seal assembly.

8. A cover assembly for a receptacle having a rim at an open end thereof, the cover assembly comprising:

a lid assembly configured for releasable engagement with the receptacle over the open end thereof, the lid assembly comprising a lid assembly wall having an inner surface, and an inner ring extending radially inward from the lid assembly wall, the inner ring defining a plurality of fluid passages, the lid assembly further comprising an annular projection extending axially from the inner ring to a free end of the lid assembly, the annular projection and the inner surface of the lid assembly wall defining a receptacle gap therebetween, the lid assembly configured to receive at least a portion of the receptacle rim within the receptacle gap when the lid assembly is releasably engaged to the receptacle; and a seal assembly configured to be retained by the inner ring, the seal assembly comprising an upper lip, wherein the lid assembly and the seal assembly are configured relative to each other such that the seal assembly is resiliently deformable between a sealed configuration and an unsealed configuration, wherein:

in the sealed configuration, the upper lip sealingly engages the inner surface and fluid is prevented from flowing through a lid assembly volume defined between the lid assembly and the seal assembly, and in the unsealed configuration fluid is permitted to flow from the receptacle, through the plurality of fluid passages, and between a gap defined by a portion of the upper lip and a corresponding portion of the inner surface.

9. The cover assembly of claim 8, wherein the inner ring comprises a retention lip, the seal assembly defines a retention groove, and the seal assembly is configured to be retained by the inner ring by retaining the retention lip within the retention groove.

10. The cover assembly of claim 8, wherein the receptacle rim seals against at least one of the lid assembly wall and the annular projection when the lid assembly is releasably engaged to the receptacle.

11. The cover assembly of claim 8, wherein the fluid passages are radially extending slots distributed about the circumference of the inner ring.

12. The cover assembly of claim 8, wherein the seal assembly further comprises a plurality of ridges distributed adjacent to the upper lip such that the ridges abut the inner surface and wherein, in the unsealed configuration, the seal assembly resiliently deforms about at least a portion of the ridges.

13. The cover assembly of claim 8, wherein the seal assembly further comprises a one-way vent feature through which air flows into receptacle during drinking of fluid therefrom in the unsealed configuration.

14. The cover assembly of claim 8, wherein the seal assembly is resiliently deformable between the sealed configuration and the unsealed configuration by applying force to the seal assembly.

* * * * *